US005335870A

United States Patent [19]

Martin

[11] Patent Number: 5,335,870

[45] Date of Patent: Aug. 9, 1994

[54] FLYING PASTER

[75] Inventor: John R. Martin, Rockford, Ill.

[73] Assignee: Martin Automatic, Inc., Rockford, Ill.

[21] Appl. No.: 136,169

[22] Filed: Oct. 15, 1993

Related U.S. Application Data

[62] Division of Ser. No. 935,859, Aug. 26, 1992, abandoned.

[51] Int. Cl.[5] ..... B65H 19/16; B65H 19/18

[52] U.S. Cl. ..... 242/555.4; 242/556; 242/596.5

[58] Field of Search ..... 242/58.1, 58.2, 58.3, 242/58.4, 58.6

[56] References Cited

U.S. PATENT DOCUMENTS

| | | | |
|---|---|---|---|
| 4,564,150 | 1/1986 | Keene et al. | 242/58.1 |
| 4,729,522 | 3/1988 | Tafel | 242/58.3 X |
| 4,875,633 | 10/1989 | Mochizuki et al. | 242/58.3 |
| 4,934,621 | 6/1990 | Jacobs | 242/58.3 |

*Primary Examiner*—John M. Jillions

*Attorney, Agent, or Firm*—McAndrews, Held & Malloy, Ltd.

[57] ABSTRACT

A flying paster is disclosed that achieves straight across splicing by utilizing web roll core drive technology. Splice calculations are based on input data sensed during preliminary acceleration of the new roll, which is disposed in a splicing position in the flying paster. Acceleration of the new roll is achieved by engagement between the center core shaft of a new roll and a movable brake and roll accelerator assembly. Then, calculations facilitate speed matching between the web running from a second, running roll mounted in the flying paster and the new roll. Splicing is facilitated by the utilization of two, two-sided adhesive strips. One adhesive strip is used to adhere the leading end of the new roll to the rest of the body of the new roll during the pre-splice speed matching, and the second adhesive strip is used for adhering the leading end of the new roll with the newly cut, trailing end of the running web. After splicing, the new, now-running web roll and the movable brake and roll accelerator assembly are moved from the splicing position to an operating position in the flying paster. In the latter position, control over the new, now-running roll is transferred from the movable brake and roll accelerator assembly to a fixed brake and brake accelerator assembly disposed in the flying paster adjacent to the operating position. The movable brake and roll accelerator assembly are then returned to a position adjacent the splicing position so as to be ready for the next, new roll.

8 Claims, 10 Drawing Sheets

FIG. 4
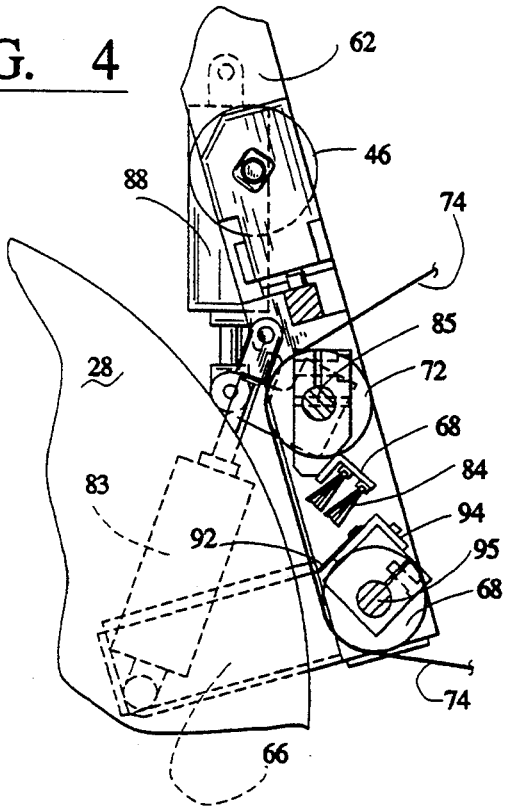
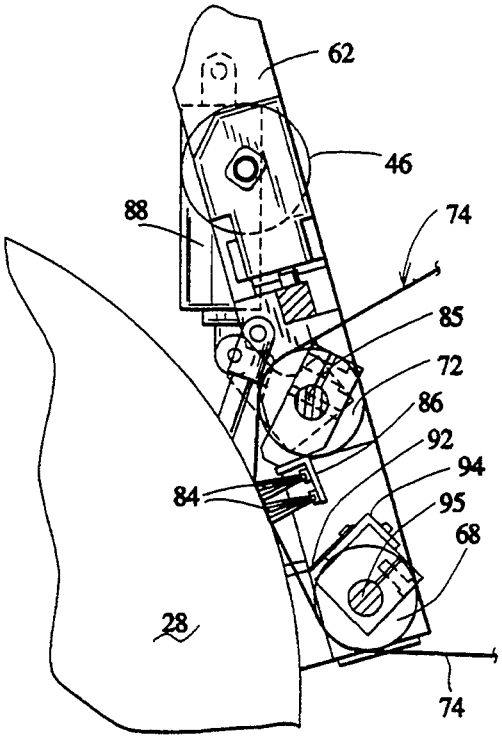
FIG. 5
FIG. 6
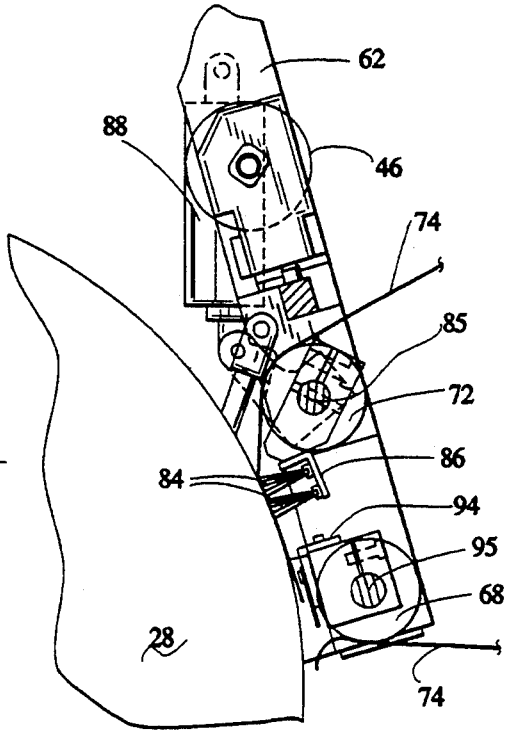

FLYING PASTER

This is a divisional application of application Ser. No. 07/935,859, filed Aug. 26, 1992, now abandoned.

BACKGROUND OF THE INVENTION

This invention relates to a flying paster, and more particularly, to a flying paster used to splice the leading end of a web from a new roll to the trailing end of a web running from a second roll. The splice is made while both rolls are being rotated at running web speed and while the running web is maintained under full brake/-tension control.

Various types of flying pasters have been available and used for years in the web handling industry usually as an option or alternative to zero-speed web splicers. Flying pasters have found particular utility in newspaper printing press applications, that is, for splicing rolls of news print stock being fed to newspaper printing presses. In such applications, especially when the printing presses are housed in older buildings where useable floor space is at a premium, the ability to arrange flying pasters in vertical stacks has proved to be a marketable advantage.

In the past, flying pasters have had recognized practical problems which have limited their application and utility. These problems include the need to apply surface belts to the surfaces of the new rolls in order to drive the new rolls up to a speed matching the speed of the running web, and in some instances, to maintain web tension control after a splice. These surface belts have a disadvantage in that they tend to disturb the surface fibers of the web and prevent the use of simple splice preparations, as compared with zero-speed-splicer splice preparations. Indeed, most flying paster splice preparations are relatively complex, requiring the use of tabs, and precluding the use of continuous, straight-across splices achieved by a single strip of transfer adhesive. Additionally, prior commercially available flying pasters have required relatively expensive DC drives or mechanical press connections.

In sum, the concept of a flying paster, that is, splicing webs without stopping the running of the webs, is excellent in theory. Nonetheless, prior attempts to commercially employ this concept have encountered serious practical drawbacks that have generally relegated the flying paster to a second choice status as compared to zero-speed splicers. The need for an improved flying paster, which would realize the theoretical potential in a practical, work-a-day embodiment, has long been recognized by those working in the web handling industry.

SUMMARY OF THE INVENTION

In principal aspects, the improved flying paster of the present invention represents a unique, revolutionary approach that successfully overcomes traditional flying paster problems. Its design maintains a degree of simplicity far beyond that of competitive flying pasters. The creative use of core drive technology eliminates the need for surface drive belts and avoids the need for the more complicated, and expensive, DC drive packages or mechanical press drive connections. A straight across splice preparation also adds to the simplicity and ease of operation of the flying paster of the present invention. Key features of this invention can be applied to many different types or configurations of flying pasters, including side-by-side, turret and stackable versions.

Another significant advantage of the flying paster of the present invention includes its use of two full capacity brake and accelerator assemblies; a moveable one for the new roll, and a fixed one for the running roll. One or the other of these brake and accelerator assemblies is controlled, during all phases of operation, by a single roller, inertia compensated, pneumatically loaded, linear tension control dancer located at the output end of the flying paster. This assures that the unwinding roll is under positive tension control at all times. The moveable brake and accelerator assembly, which is connected with a new roll when it is loaded in the paster, stays with that roll through the entire splicing operation. It is not disconnected from the new roll until the fixed position brake and accelerator assembly has been connected with the new, now-running roll and is ready to control the further operation of that new, now-running roll.

The flying paster of the present invention achieves, in significant part, physical simplicity from its utilization of sophisticated drive software programs to control the brake accelerator assemblies. While other flying pasters have used core acceleration techniques, the present paster is the first, it is believed, to achieve speed matching by the use of a simple three-phase AC motor drive technology.

The physical simplicity of this flying paster offers another, commercially significant advantage. In its stackable version, the flying paster of the present invention can be stacked up to four high in the same space needed to accommodate three stacked, competitive flying pasters.

As a part of the simplicity of the splice preparation, a first strip of high-tack, low-tack adhesive may be applied, either to the undersurface of the leading edge of the leading end or to the new roll surface, one wrap back from the leading edge of the new roll. This first adhesive strip is applied so that it is slightly back from the leading edge, with the low tack side against the body of the roll. Thereafter, the leading end is squarely and tightly wrapped about the body of the new roll and the high-tack, low-tack strip alone holds the leading end securely to the new roll until the splice is made. The use of this high-tack, low-tack adhesive strip assures that the strip will pass through the press with the splice, not one wrap back from the splice which would cause additional waste.

A second transfer adhesive strip or tape is applied to the outer surface of the leading end so as to overlie the high-tack, low-tack adhesive strip and extends across the full width of the leading edge of the leading end of the new roll. This second strip is disposed close to but does not overlap the leading edge.

After the new roll has thus been prepared for splicing, the new roll may be loaded into the flying paster of the present invention. It is there positioned in a splicing position, and the ends of its center core shaft are connected with the movable brake and roll accelerator assembly. The new roll may then be accelerated such that the paster control circuitry can determine the diameter of the new roll, the weight of the new roll, the angle between a predetermined brake impulse and an optically scannable mark, which was made on the new roll during roll splice preparations, the frictional forces involved in the paster and the efficiency of the movable brake and roll accelerator assembly. During this mode, a relatively small encoder wheel is brought into contact with the outer peripheral surface of the new roll. After these electronic determinations have been made, the new roll may then be brought to a stop until it is time for that splice to occur.

At the time of the splice, a splicing assembly is used to position the running web adjacent to the outer peripheral surface of the new roll. The movable brake and roll accelerator is actuated to bring the new roll up to a speed which matches the speed of the running web. A set of brushes moves the running web into surface-to-surface contact with the outer peripheral surface of the new web and holds this contact, over substantially an entire revolution of the new roll, so as to give the surfaces time to stabilize. As the transfer tape, which is adhered to the leading end of the new roll, passes beneath the splicing assembly, a knife sub-assembly is actuated and cuts the old web. With the cutting of the web, a splice is achieved.

Prior to the splice, the old web is being withdrawn or unwound from a second roll, which is disposed in an operating or running roll position in the flying paster. The center core shaft of this second roll is connected with the fixed brake and brake accelerator assembly. Signals from the inertia-compensated-dancer control, through the paster control circuitry, this fixed assembly so as to maintain the running web under positive tension control at all times.

As soon as the splice has occurred, input signals from the inertia compensated dancer are employed, through the control circuitry, to control the moveable brake and roll accelerator assembly which is connected with the new, now-running roll. Thereafter, the center core shaft of the second roll is disconnected from the fixed brake and brake accelerator assembly, and the remainder of the second roll, including its center core shaft, is moved from the operating position to a discharge chute. The new, now-running roll, together with the movable brake and roll accelerator assembly, is then moved from the splicing position to the operating position. Once the new, now-running roll is at that latter position, the fixed brake and brake accelerator assembly is accelerated up to a matching speed and is then connected with an end of the center core shaft of the new, now-running roll. After the new roll and the fixed assembly have been connected, the new roll's center core shaft is disconnected from the moveable brake and roll accelerator assembly, and that moveable assembly is returned to its position adjacent the splicing position so as to be ready for the next new roll.

Accordingly, it is a primary object of the present invention to provide an improved flying paster, as described, that overcomes traditional flying paster problems and that presents a genuine, practical alternative to zero speed splicers.

Another object of the present invention is to provide a novel method of preparing a new roll for splicing by the utilization of a high-tack, low-tack adhesive strip, together with a transfer adhesive strip, where the high-tack, low-tack strip is used to hold the leading end of the new roll to the remaining body of the new roll during speed matching prior to the splice and where the transfer strip is used to adhere the leading end of the new roll to the trailing end of the running web at the splice. A related object of the present invention is to provide an improved method for preparing the new roll for splicing as described wherein the diameter of the new roll; the weight of the new roll; the angle between a predetermined brake impulse, which is imposed on the new roll by the moveable brake and roll accelerator assembly, and a color mark made on the outer periphery of the new roll adjacent to the leading edge during roll preparation; the frictional forces involved; and the efficiency of the moveable brake and roll accelerator assembly is determined during initial rotation of the new roll.

Still another object of the present invention is to provide an improved flying paster, as described, which has a exceedingly simple, straightforward design, vis-a-vis competitive, commercially available flying pasters, which uses novel core drive technology, and which maintains positive tension control at all times on the running web.

These and other objects, advantages and benefits of the present invention will become more apparent from the following detailed description of the preferred embodiment of the present invention that may be best understood with reference to the accompanying drawings.

DESCRIPTION OF THE DRAWINGS

The various figures of the drawings are as follows:

FIG. 4 is a partial, enlarged cross-sectional view taken along the line 4—4 in FIG. 2, and with a new roll being shown mounted in the flying paster.

FIG. 5 is a partial, cross-sectional view, similar to that shown in FIG. 4, showing the running web being pressed against the peripheral surface of the new roll;

FIG. 6 is a partial, cross-sectional view, similar to that shown in FIGS. 4 and 5, showing the running web being cut during the splicing operation;

DESCRIPTION OF THE PREFERRED EMBODIMENT

Figure 2:
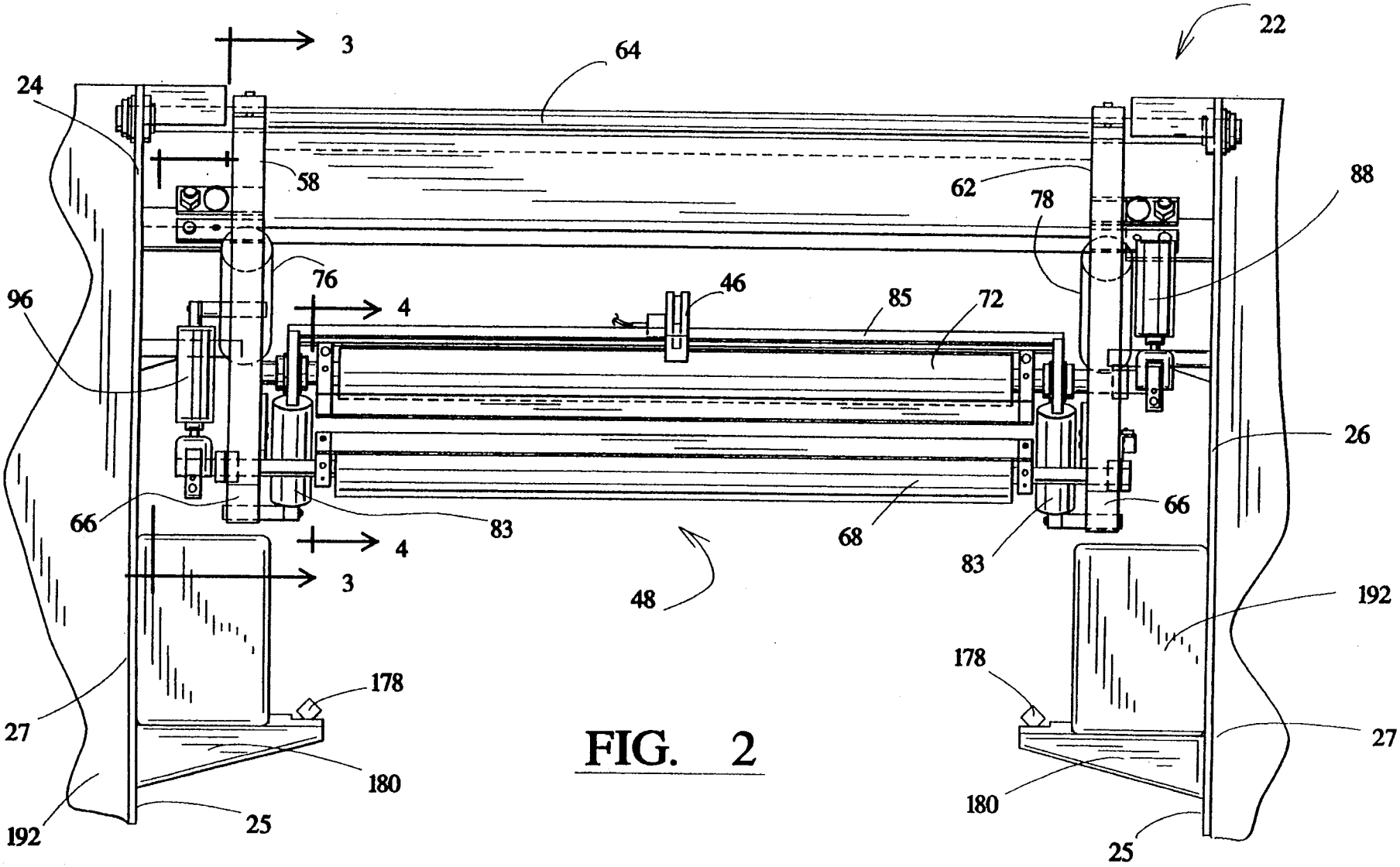
FIG. 2 is a partial, left end or roll entry end, elevational view of the flying paster of FIG. 1, with the web rolls removed from the paster.

The preferred embodiment of the flying paster in the present invention is illustrated generally at 22. With particular reference to FIG. 2, the flying paster 22 has a gear side or left side wall 24 and an operator side or right, side wall 26. These vertically disposed walls 24 and 26 are spaced apart and are substantially parallel so that they have interior or inner-facing surfaces 25 and exterior or outward-facing surfaces 27. The walls 24 and 26 are supported by a plurality of transverse support members, some of which are generally indicated at 29. The upper and lower ends of the walls are designed so that, the paster 22 can be vertically stacked with other similar pasters if so desired. The spacing between the facing surfaces 25 of these side walls 24 and 26 is sufficient so that conventional rolls of web material, as for example, paper, may be mounted therebetween for rotation during which web material may be unwound from one of the rolls.

Figure 1:
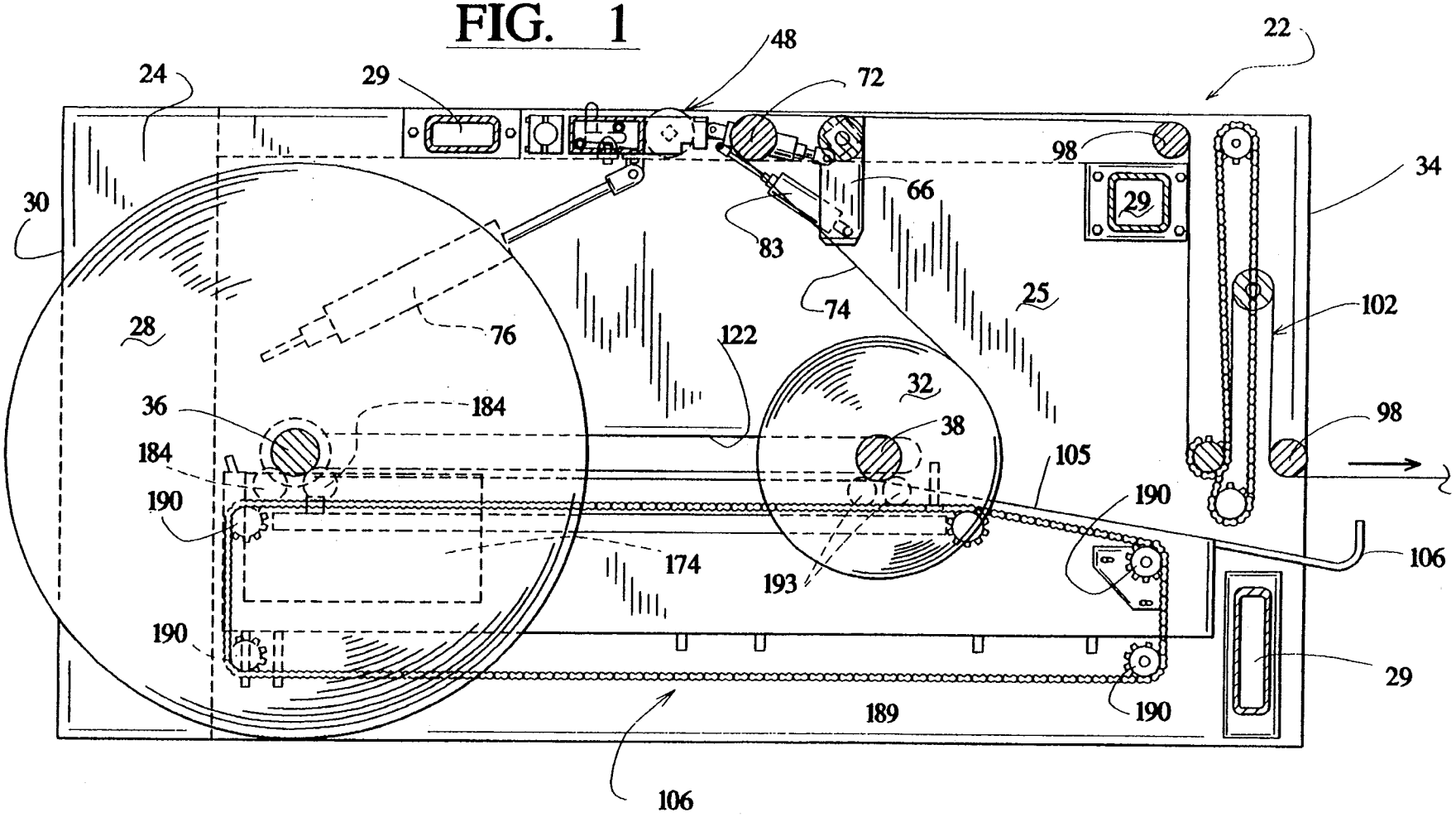
FIG. 1 is a partial, longitudinal, operator side, vertical cross-sectional view of a flying paster embodying the present invention.

As best shown in FIG. 1, a new roll of web material 28 is disposed in a splicing position adjacent to the entry end 30 of the paster 22. Similarly, a second or running roll 32 is disposed in its operating or running roll position adjacent to the exit end 34 of the paster. The rolls 28 and 32 are mounted on steel center core shafts 36 and 38, respectively. These shafts are of conventional design and construction except as otherwise noted hereinbelow. Both ends of each of the shafts 36 and 38 include pin receiving notches 40 (see FIG. 8) so as to enable them to receive a driving pin as hereinafter described. For now, suffice it to say that the center core shaft 36 is adapted to be connected, at its gear side end, with a moveable brake and roll accelerator assembly 42. Similarly, the operator side ends of the center core shafts 36 and 38 are adapted to be connected with a fixed brake and brake accelerator assembly 44.

Prior to being loaded in the paster 22, the new roll 28 should be prepared for a splice. In this regard, the leading edge of the leading end of the new web (that is, the web wound about the new roll 28) should be trimmed square. A single strip of one-half inch wide conventional high-tack, low-tack adhesive is applied, either to the leading edge or to the roll surface one roll wrap back from the leading edge. A high-tack, low-tack adhesive strip, which is preferred, is one marketed by the 3-M Company of St. Paul, Minn. (3M Industrial Specialties Division) product No. 928-100.

One splice preparation sequence, which is simple and effective, is tearing the leading end of the new web using a carpenter's square so as to assure that the web leading edge is straight across its entire width. The leading end of the web is then folded back and a full web width (from side to side) strip of the high-tack, low-tack adhesive is positioned on it, one-eighth of an inch to three-sixteenths of an inch back from the leading edge, with the high-tack side face down, that is, in contact with the inwardly facing surface of the leading end. The leading end of the web of the new roll is then folded back so that the low-tack side of the high-tack, low-tack adhesive strip securely holds the leading edge to the outer peripheral surface of the body of the roll 28. This assures that the high-tack, low-tack adhesive strip will pass through the press with the splice, and not one wrap back from the splice which would cause additional web wastage. Care should be taken that the outer wraps of the roll are lined up with the side edges of the roll and are pulled taut and square.

A conventional strip of regular, one-inch wide transfer adhesive is then applied across the full width (that is, from side to side) of the new roll as close to but not overlapping, the leading edge as possible. A suitable transfer tape is marketed by North Shore Consultants, Inc. of Chicago, Ill., Tape No. 3765. The backing is removed from the tape, although as with zero-speed splicing, it may be desirable, in dusty environments, not to remove the backing until near the time for a splice.

A conventional black marker pen is used to make a mark or line immediately behind the strip of transfer adhesive. The black mark or line should be made so that it is aligned with an encoder wheel 46, which is part of the paster's splice assembly 48, when the new roll is disposed in the splicing position in the paster 22, as hereinafter described. This black mark is to be tracked by a conventional optical sensor, not shown, mounted on and carried by the encoder wheel 46.

After the new roll 28 has thus been prepared for splicing, it is loaded, by a means of a conventional hoist, not shown, into the paster 22. The hoist may be an integral part of the paster 22 or may be a separate piece of equipment. The hoist will pick up the new roll by the ends of its shaft 36 and place it sufficiently near or at the splicing position so that the shaft 36 may be connected with the moveable brake and roll acceleration assembly 42.

Figure 12:
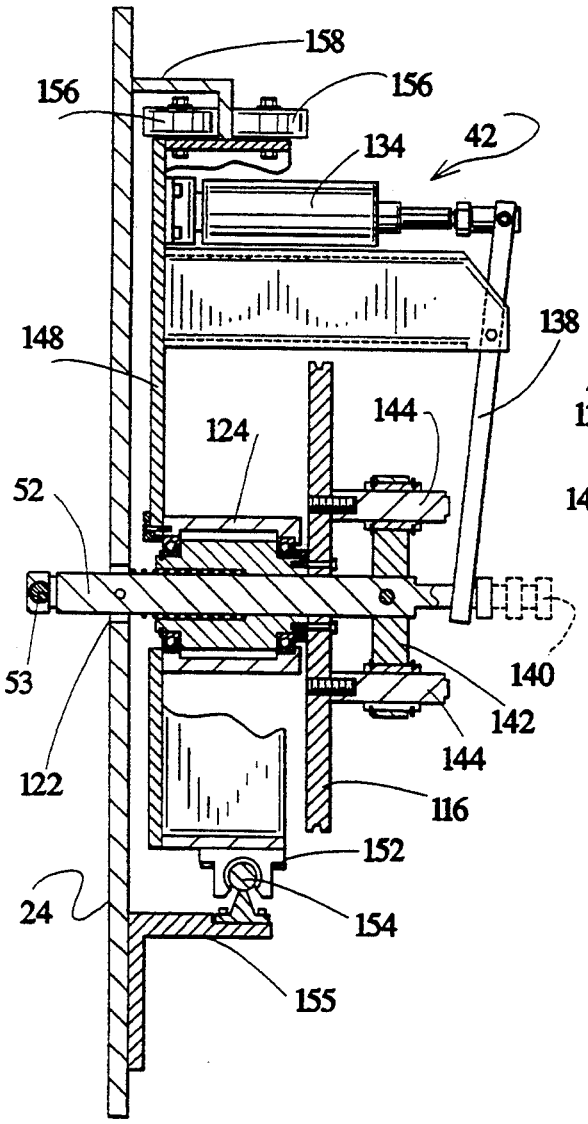
FIG. 12 is a partial, cross-sectional view taken along the line 12—12 in FIG. 11.
Figure 13:
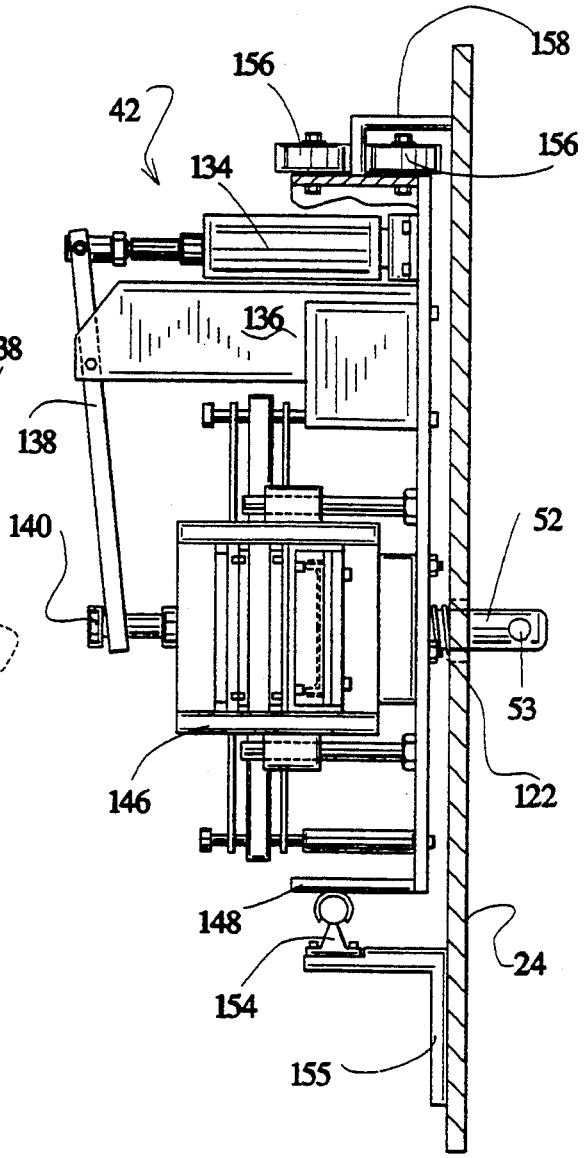
FIG. 13 is a partial, cross-sectional view taken along line 13—13 in FIG. 11.

After the new roll 28 is loaded in the flying paster 22, the paster operator may cause the roll 28 to be moved to its final splicing position. As generally shown in FIGS. 12 and 13, a spring biased brake spindle or coupling member 52 of the moveable assembly 42 is caused to be extended so as to be connected with the notched gear side end of the shaft 36. (Specifically a transverse connection pin 53 carried at the distal end of the spindle 52 will engage the notches 40.) An accelerator motor 54, which is part of the assembly 42, is also actuated. This assures that the pin 53 of the spindle 52 properly seats in the notched adjacent end of the core shaft 36 and results in a slow rotation of the new roll 28. As this rotation occurs, the roll 28 is moved forward, toward the end 34, until the roll surface breaks a cross-paster positioning beam, not shown. Once this beam is broken by the roll surface, the roll 28 is inched back toward the end 30, until no point around the circumference of the new roll 28 cuts the beam. Finally, the roll 28 is "kicked" forward to remove any backlash in the roll. The accelerator motor 54 is then shut off and the assembly 42 stops the rotating new roll 28. Roll 28 remains stationary in the splicing position until the splice assembly 48 is lowered from its retracted position, shown to its extended position, shown in FIGS. 2–6. In this latter position, the assembly 48 is positioned adjacent to the outer peripheral surface of the new roll, as best illustrated in FIGS. 3–6.

Figure 3:
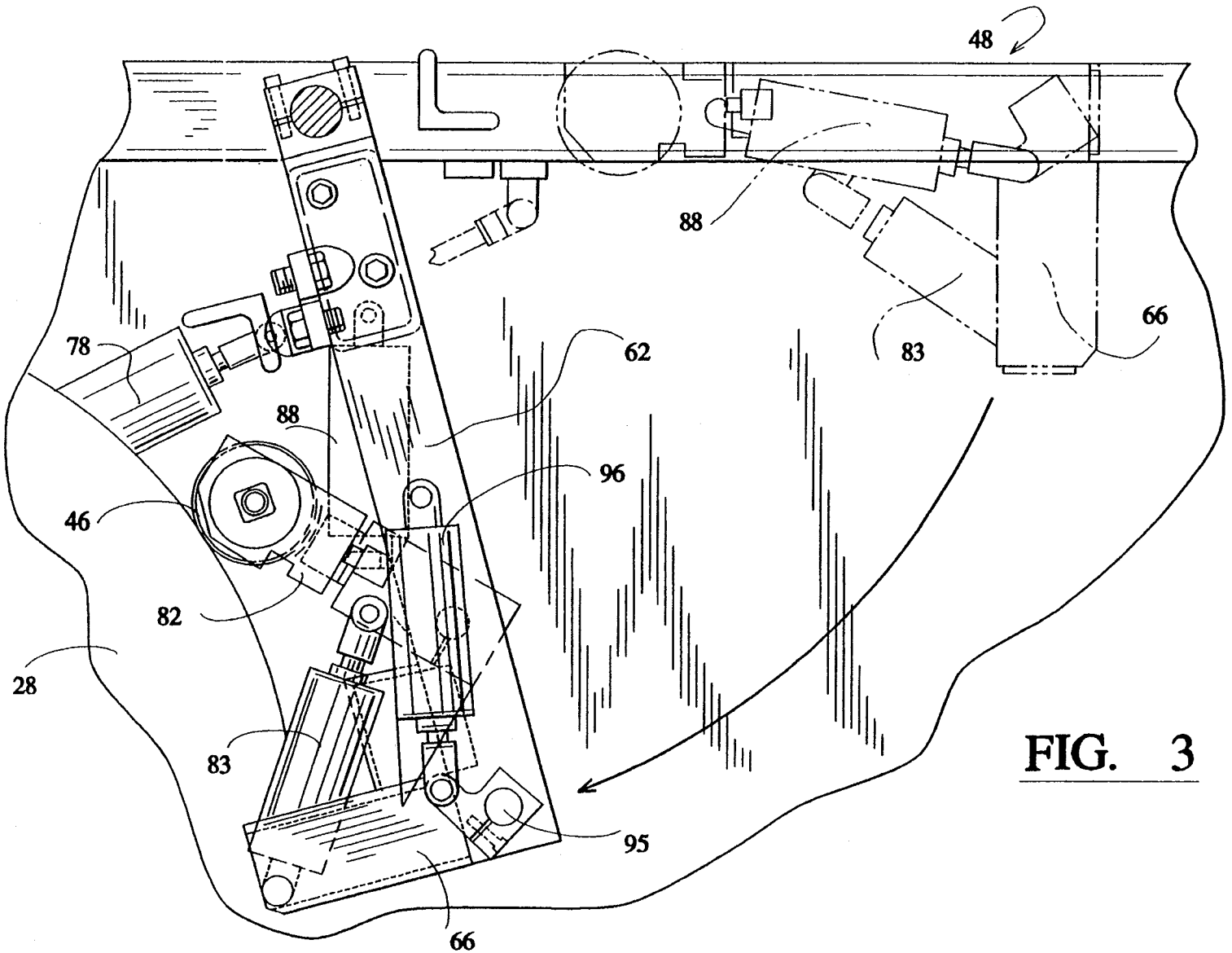
FIG. 3 is a partial, enlarged cross-sectional view taken along the line 3—3 in FIG. 2, and with a new roll being partially shown mounted in the flying paster.

Referring now to FIGS. 2 and 3, the splice assembly 48 includes two side arms 58 and 62 disposed adjacent to the facing surfaces 25 of the side walls 24 and 26, respectively. These arms are mounted for pivotal movement on and about a cross rod 64 that extends between the side walls 24 and 26. Each of the distal ends of the arms 58 and 62 include a bracket 66 that is perpendicularly disposed, with respect to the longitudinal axis of its arm, and that projects generally toward the end 30 when the assembly is in its extended position.

A lower idler roller 68 is supported for rotation by the distal ends of the arms 58 and 62. An upper idler roller 72 is similarly supported, at its ends, by the arms 58 and 62, intermediate the ends of the arms 58 and 62. The running web 74 (that is, the web running from the second roll 32) passes about the lower idler roller 68 and then about the upper idler roller 72, as best seen in FIGS. 4–6, so that a portion of the running web passes closely adjacent to a portion of the outer peripheral surface of the new roll 28 when the splice assembly 48 is in its extended position.

Conventional double acting fluid cylinders 76 and 78 cause the splice assembly 48 to be lifted between its retracted or upper position and its extended or lower position. The lift cylinders 76 and 78 are mounted on brackets attached to the side walls 24 and 26 and have their rod ends connected with the arms 58 and 62, respectively.

As noted, the splice assembly 48 also includes the encoder wheel 46. It is mounted at one end of an encoder arm 82. The other end of the arm 82 is mounted on a transverse rod 85 that extends substantially between but is not supported by the arms 58 and 62. The encoder arm 82, and thus the encoder wheel 46, may be pivoted between a first or retracted position where the encoder wheel lies in a plane of the arms 58 and 62 and a second or extended position where the encoder wheel 46 gently rides on the outer peripheral surface of the new roll, as shown in FIG. 3. Actuation of a pair of conventional, double acting fluid cylinders 83 causes the pivotal movement of the encoder wheel 46 between its first and second positions. The rod ends of the encoder cylinders 83 are connected with and support the ends of the encoder rod 85. The other ends of the cylinders 83 are mounted on members that extend laterally from the distal ends of the brackets 66.

The encoder wheel 46 is of conventional design, has a relatively narrow cross-sectional width, particularly when compared with the overall width of the new roll 28, so that its contact with the new roll does not unduly disturb the fibers of the web of the new roll. Mounted adjacent to the encoder wheel is a conventional optical scanner, which as noted above is not shown, for sensing the passage of the black mark or line which is applied to the outer surface of the leading end of the new roll during roll splice preparation.

A brush subassembly including a set of brushes 84, two which are shown, extends from side to side across the new roll 28. The brushes are mounted in a brush carrying bracket 86. This bracket is pivotally mounted on and about a rod 85 extending between the arms 58 and 62 and may be moved from a first position, within the plane of the arms, as shown in FIG. 4, to a second position where the brushes' bristles force the portion of the running web 74 (which is running between the lower and upper idler rollers 68 and 72) against the outer peripheral surface of the new roll 28. Actuation of a conventional, double acting fluid cylinder 88 causes the pivotal movement of the brush bracket 86, and thus the brushes 84, between their first and second positions. This brush cylinder 88 extends between the brush bracket 86 and lateral member carried by the arm 62.

The splice assembly 48 also includes a knife subassembly including a knife 92 that is adapted to cut the running web 74 at the time of a splice. The transverse dimension of the knife 92 is greater than the width of the running web 74. The knife 92 is supported by a knife holding bracket 94 that is pivotally mounted on and about the operator side stub shaft 95 of the lower idler roller 68 and between the roller 68 and the arm 62. This knife holder bracket 94 may be moved between a first position where the knife 92 is disposed between the plane of the arms 58 and 62 and a second position wherein it extends beyond this plane, toward the new roll, so as to cut the web 74 running between the lower and upper rollers 68 and 72. Actuation of a conventional, double acting fluid cylinder 96 moves the knife holder bracket 94 between its first and second positions. The knife cylinder 96 extends from lateral member attached to the bracket 94 and a lateral member attached to the arm 58.

As noted above, in a method unique to the flying paster 22, important information about the new roll 28 and the running condition of the paster is collected and determined prior to splicing. This may begin when the splice assembly 48 is lowered to its extended position by actuation of the cylinders 76 and 78. Normally, the paster control circuitry causes this to automatically occur when the running roll 32 reaches a predetermined, sensed diameter. After the splice assembly is thus lowered, the encoder wheel 46 is moved, by actuation of the encoder cylinders 83, into a gentle surface-to-surface contact with the outer peripheral surface of the new roll. The moveable assembly 42 is then actuated so that the accelerator motor 54 again begins rotating the new roll 28. Using the known torque of the accelerator motor 54, a periodic (that is, once per revolution) probe pulse from the assembly 42, the encoder information, and the signal from the leading edge sensor (that is, the sensing of the black mark behind the second or transfer strip), the paster control circuitry can determine the new roll's diameter, the roll's weight, and the angle between the brake pulse and the leading edge of the web.

Following this acceleration of the roll 28, there is a period of time when the accelerator motor 54 is turned off, and the new roll 28 is allowed to coast. This permits a determination of the system friction. Finally, the brake of the assembly 42 is applied with a known pressure, and its efficiency is measured. Not only does this acceleration and coast provide important information about the new roll 28, it also monitors the condition of the paster 22 so as to permit automatic adjustments for normal wear and tear.

Thereafter, the encoder wheel 46 is moved away from its surface-to-surface contact with the new roll to its retracted position. The encoder wheel is normally not used again during a paster cycle. It could, however, be used to provide speed matching information if low speed splicing were desired.

A second, conventional encoder, not shown, is mounted on one of the exit idler rollers 98 in the paster adjacent to its exit end 34. This second encoder is used to provide running web speed information to the paster control circuitry.

The paster control circuitry can calculate when speed matching can begin using the control signal from the second encoder, the operator—set roll—32 splice diameter (that is, the diameter of the roll 32 at which splicing is to begin), and the information determined during the initial acceleration. Because nothing is touching the outside surface of the new roll 28 during this time period, there is no reason or need to have the roll 28 accelerated rapidly to a match speed. This allows the use of small (that is, a one horsepower) accelerator motor 54 in the roll acceleration phase.

When a speed match occurs (that is, when the speed of the new roll 28 matches the speed of the running web 74), and the running roll 32 reaches its pre-set splice diameter, the splicing operation may commence. The specific timing of the splice is made with reference to the periodic brake pulse signal and its previously measured angle with the leading edge of the new roll. This information determines the time of firing of the brushes 84 (that is, moving the brushes 84 from their retracted position shown in FIG. 4 to their extended position shown in FIG. 5) so that they press the running web 74 against the surface of the new roll immediately after the leading edge has passed underneath the brushes. This provides almost one full revolution of the new roll during which contact occurs between the two webs. This web-to-web contact, tends to stabilize them with each other before the running web contacts at the second or transfer adhesive strip.

The known position of the leading edge is used to "fire" the knife 92 (that is, pivot the knife between its FIG. 5 retracted position and its FIG. 6 extended position) so that the knife cuts or severs the running web 74. The parameters controlling the timing of the firing of the knife 92 are determined by the paster control circuitry to control the length of the spliced "tail", so that it remains constant regardless of the speed of the old running web 74.

Up until the time of the actual splice, the second running roll 32 is operating under the control of the fixed brake and brake acceleration assembly 44. The operation of this assembly 44 is, in turn, controlled by a signal received from a conventional dancer 102 in the sense that the dancer 102 includes the second encoder mentioned above. This dancer is disposed at the exit end 34 of the paster 22, and the running web 74 passes through it as the web exits from the paster. The dancer 102 is a single roller, inertia compensated, pneumatically loaded linear dancer. The dancer control signal is switched, by the paster control circuitry, from the assembly 44 to the assembly 42 at the time of the splice. The use of this dancer control signal to control the assembly 44—while the web 74 is unwinding from the second roll 32—and to control the assembly 42—after the splice—assures that the unwinding roll, regardless of whether it is roll 28 or roll 32, is under positive tension control at all times.

After a splice has been made, the paster control circuitry causes the fixed assembly 44 to be disconnected from the center core shaft 38 of the expired second roll 32. The splice assembly 48 is also lifted to its retracted or parked position as shown in FIG. 1.

A roll-transfer drive assembly 104 is then switched on, by the paster control circuitry, so as to move both rolls 28 and 32 forward toward the exit end 34 of the paster 22. As a result, the expired roll 32, or more particularly, the center core shaft 38 and whatever web material still remains wound about it, drops or slides down a ramp 105 and into a removal trough 106 as hereinafter explained in more detail. The new, now-running roll 28 continues to move forward until it reaches the operating position and is aligned with the fixed brake assembly 44, more particularly with the brake output spindle 108 of that assembly 44.

The fixed brake assembly 44 is then accelerated so that the speed of the spindle 108 matches the speed of the new, now-running roll 32. At this point, the paster control circuitry causes the fixed brake and brake accelerator assembly's spring loaded brake connection (as hereinafter described) to connect the assembly 44 with the notched, operator side end of the center core shaft 36. Thereupon, the control signal from the dancer 102 is again switched, by the paster control circuitry, from the assembly 42 to the assembly 44 and thereafter used to control the operation of the assembly 44. (And the dancer signal ceases to control the operation of the moving assembly 42.) The paster control circuitry causes the moving assembly 42 to be disconnected from the gear side end of the shaft 36 by the retraction of the spring loaded spindle 52. Then the assembly 42 is moved back, adjacent to the splicing position, near the entry end 30 of the paster 22, to await the positioning of the next new roll.

Figure 11:
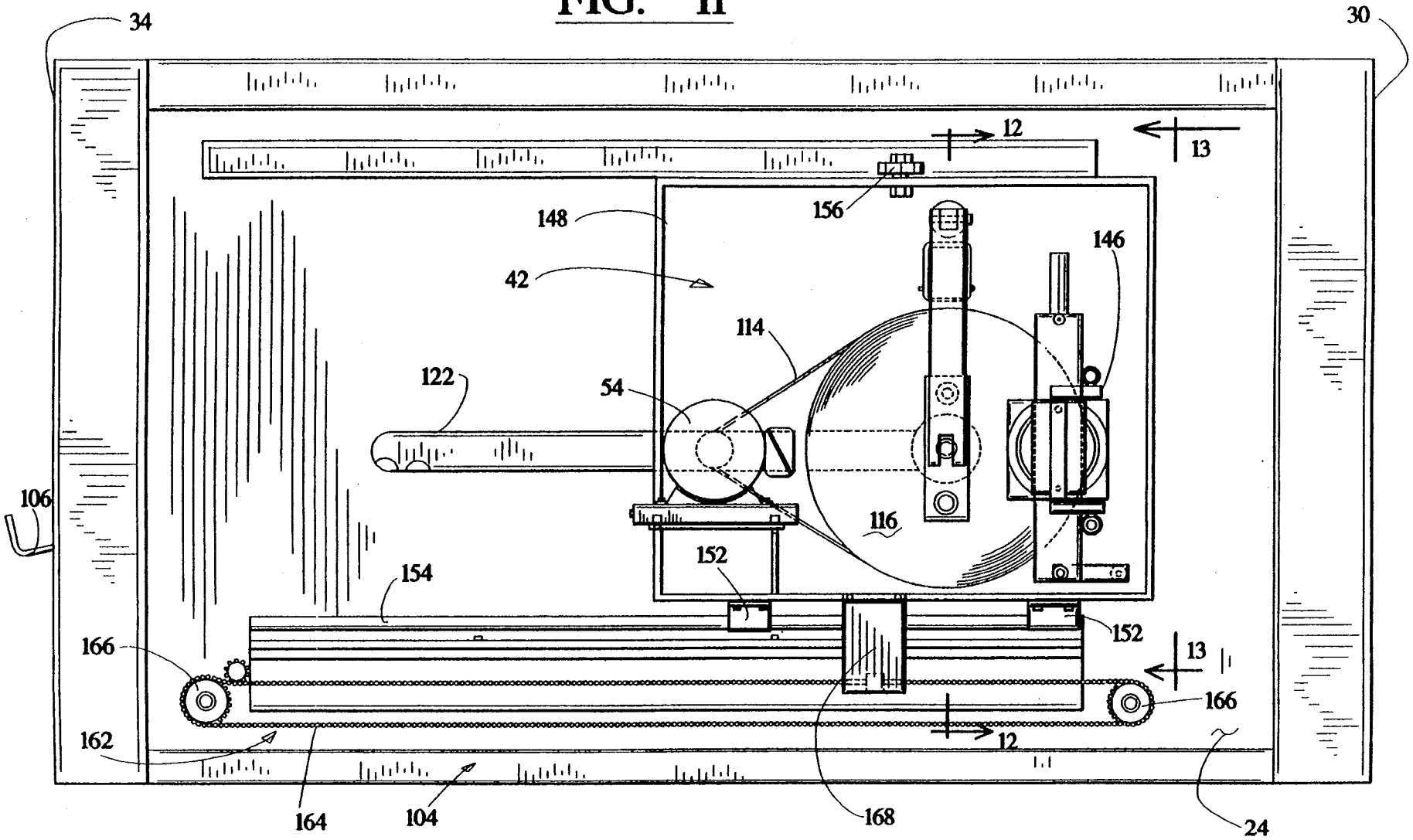
FIG. 11 is a longitudinal, gear side, elevational view of the flying paster of FIG. 2 showing the movable brake and the roll accelerator assembly in its position adjacent to the splicing position of the new roll.

As best shown in FIGS. 11–13, the moveable brake and roll accelerator assembly 42 includes, as noted above, the conventional AC electric motor 54 that drives or rotates, via a "V" belt 114, a conventional single brake disc 116. The centrally disposed brake spindle 52 projects through an elongated opening 122 in the side wall 24. The brake disc 116 and spindle 52 are mounted for rotation on a conventional brake hub assembly 124. The distal end of the spindle 52, as noted above, projects into the interior space between the side walls 24 and 26. It includes a transverse drive pin 53 which is adapted to engage the notches 40 in the adjacent, gear side end of the center core shaft 36 of a new roll 28.

The distal end of the spindle 52 is adapted to be, as noted above, moved between a first or projected position, where the drive pin 53 may engage the notches 40, and a second or retracted position where the distal end does not project far enough into that interior space so that the pin 53 does not engage the notches 40. The brake hub 124 includes a central recess. A coil compression spring 132 is disposed within that recess and biases the spindle 52 to its projected position.

The actuation of a conventional, double acting fluid cylinder 134 causes the spindle 52 to move between its retracted and projected positions. The cylinder 134 is mounted on a bracket 136. The rod end of the cylinder 134 is connected with one end of an elongated arm 138, which is pivoted, intermediate its ends, on the outward-facing end of the bracket 136. The other end of the arm 138 is connected with the outward-facing end 140 of the spindle 52. Thus, actuation of the cylinder 134 causes the arm 138 to pivot, and this, in turn, causes the spindle 52 to move between its retracted and projected positions.

The end 140 of the spindle 52 is fixed to a cross member 142 whose outer ends are supported by conventional Thomson linear bearings 144. These bearings 144 are, in turn, supported on the outside surface of the brake disc 116 and project perpendicularly outwardly from the face of the brake disc. The bearings 144 guide and facilitate the movement of the spindle 52 with respect to the brake disc 116 and brake hub 124.

A conventional, double caliber brake mechanism 146 is mounted adjacent to the peripheral edge of the brake disc 116 and diametrically opposite from the motor 54. The mechanism 146 functions, in a conventional manner, to brake the rotation of the disc 116, the spindle 52 and thus the new roll 28. Its operation is controlled by the paster control circuity as described herein.

The mechanism 146 is mounted on a wall of a box-like structure 148 in a conventional manner. The other components of the assembly 42 are also mounted, in a conventional manner, on this structure 148.

A plurality of Thomson bearings 152 are used to support the lower end of the structure 148 on a conventional Thomson linear bearing rod 154 so that the structure 148 (and thus the assembly 142) may slide and be carried along the bearing rod 154. The rod 154 is mounted on brackets 155 on the side wall 24 and adjacent to the outwardly facing surface of that wall. The length of the rod 154 is selected so that it is longer than the distance between the splicing position and operating position of the rolls 28 and 32. The longitudinal axis of the rod 154 is parallel to the plane of the adjacent side wall 24.

The side wall opening 122 is, as noted, elongated and its longitudinal axis is parallel to the longitudinal axis of the rod 154. Like the rod 154, the length of this opening 122 is longer than the distance between the rolls' splicing and operating positions so that its one end, adjacent to the entry end 30, overlies the splicing position while its other end, adjacent to the exit end 34, overlies the operating position.

To facilitate movement of the structure 148, and thus the assembly 42, along the rod 154, a pair of bearing rollers 156 cooperate with the depending leg of a L-shaped flange 158. The other leg of the L-shaped flange 158 is secured to the side wall 24. The bearing rollers 156 are mounted for rotation on the upper surface of the structure 148.

Figure 14:
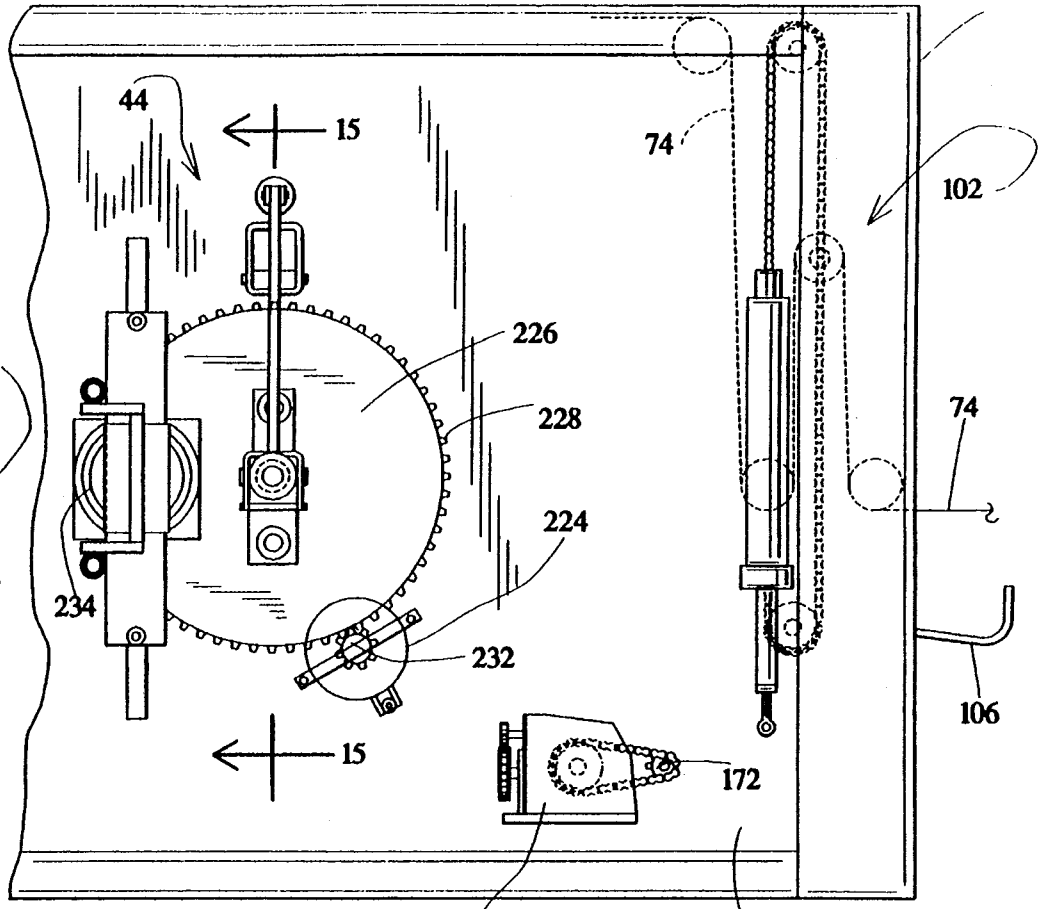
FIG. 14 is a partial, operator side, elevational view of the flying paster of FIG. 2, showing the fixed brake and brake accelerator assembly.

The roll-transfer drive assembly 104 includes a carriage assembly 162 which is best shown in FIG. 11. The assembly 162 is utilized to move the structure 148 and thus the movable assembly 42 between its first position, adjacent to the splicing position of the new roll, and its second position, adjacent to the operating position of the running roll. This assembly 162 comprises an endless chain 164 and a plurality of drive and idler sprockets, two of which are shown at 166 in FIG. 11. A carrier 168 is secured, at its lower end, to the chain 164. The upper end of the carrier 168 is connected with the lower end of the structure 148. A conventional electric motor 170, as shown in FIG. 14, is connected, via a chain drive, with the sprocketed end of a cross-paster timing and drive shaft 172. The motor 170 is utilized to drive the chain 164, and the chain 164, in turn, moves the structure 148, and thus the assembly 42, in a conventional manner along the Thomson rod 154.

Figure 8:
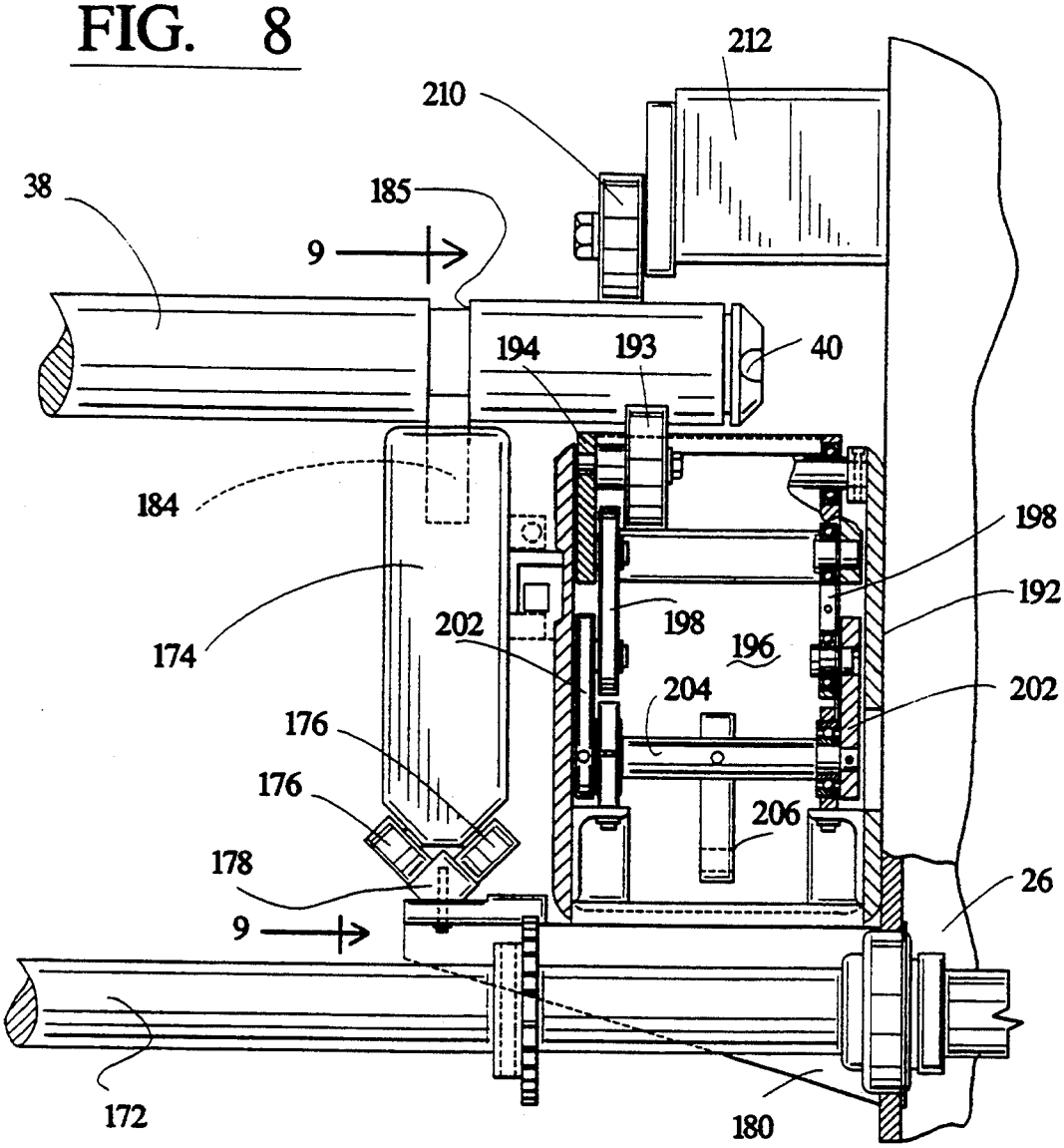
FIG. 8 is a partial, cross-sectional view taken along the line 8—8 of FIG. 7.
Figure 9:
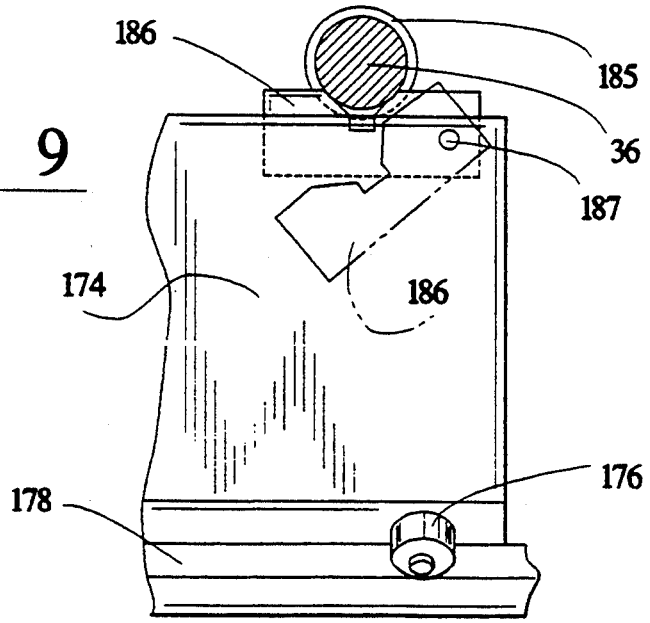
FIG. 9 is a partial, cross-sectional view taken along the line 9—9 in FIG. 8.

Referring particularly to FIGS. 1, 8 and 9, each end of shaft 36 is supported for rotation by a shaft carrier 174. Each of these carriers is structurally and functionally the same, and hence, only one will be described in detail. More specifically, each of the carriers 174 has a plurality of roller bearings 176 mounted adjacent to its lower end. They cooperate with and roll along an elongated guide 178 that is supported by brackets 180 attached to the side wall, as shown in FIGS. 2 and 8. The guides 178 are parallel to the longitudinal axis of the rod 154, and extend along the side walls from near the entry end 30 to near the exit end 34 of the paster 22.

Each of the carriers 174 has, adjacent to its upper end, two spaced apart, side-by-side rollers 184. These rollers 184 are mounted for rotation about their axes which are perpendicular to the axis of its associated guide 178 and parallel to the longitudinal axis of the shaft 36.

Grooves 185 are machined adjacent to each end of the center core shafts and are spaced, along their axes, so that the grooves 185 are aligned with the carriers 174, and more particularly, with the rollers 184 mounted on the carriers 174. Each of the rollers 184 has a width that will let them be received in and ride in a groove 185 as shown in FIGS. 8 and 9.

A pair of rollers 184 is mounted, side by side, in a support bracket 186. The two rollers 184 are spaced a distance apart in a bracket 186 such that the center core shaft 36 can be sit therebetween as illustrated in FIG. 8.

The support bracket 186 and the rollers 184 are maintained in its horizontal position during the time that the rollers support the shaft 36. They are moved to a substantially vertical position after the roll 28 arrives at the operating position. For this reason, one end 187 of each bracket 186 is pivotally connected with its associated carrier 174 such that the rollers can be moved from their horizontal position to a generally vertical position, as shown generally in FIG. 9, where the rollers are no longer disposed within the groove 185. The movement of the bracket 186 between its horizontal and vertical positions is controlled by a conventional double-acting fluid cylinder, not shown, which is actuated by the paster control circuitry.

The roll-transfer drive assembly 104 also includes a pair of endless chains 189, one of which is shown in FIG. 1. These chains 189 extend from adjacent the entry end 30 to adjacent the exit end 34 of the paster 22 and are disposed near the side walls 24 and 26. They are connected with and driven by the drive shaft 172 and thus the motor 170. A plurality of drive and idler sprockets 190 support the chains 189. Each chain 189 is connected with its adjacent carrier 174 and serves to move that carrier, and the shaft 36, between the splicing and operating positions. Since chains 164 and 189 are "tied" together by the shaft 172, the carriers 174 and the structure 184 (and the assembly 42) are always moved together.

Figure 7:
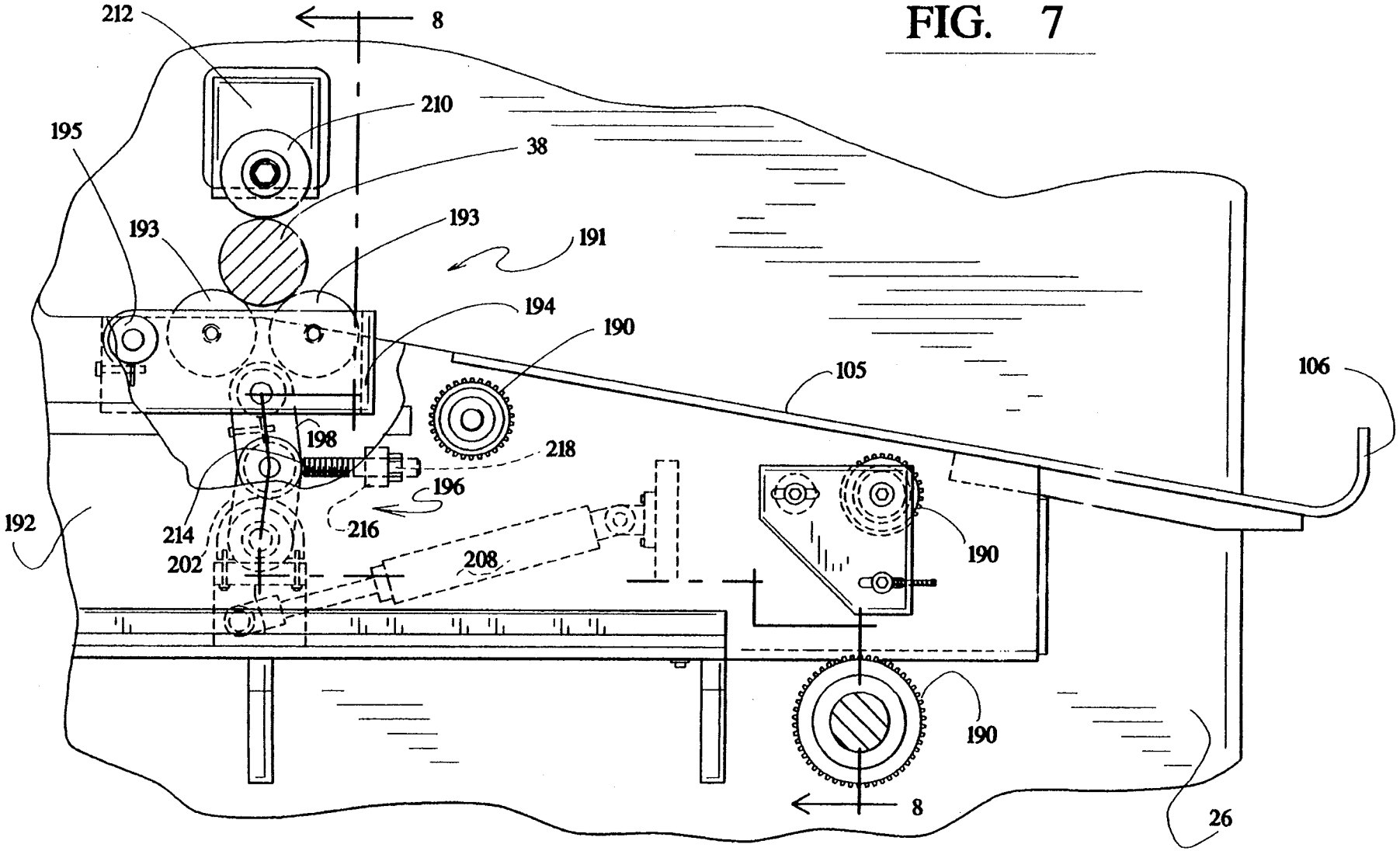
FIG. 7 is a partial, operator side, vertical cross-sectional, view showing the core shaft mounting assembly for the running roll when it is disposed in its operating position.
Figure 10:
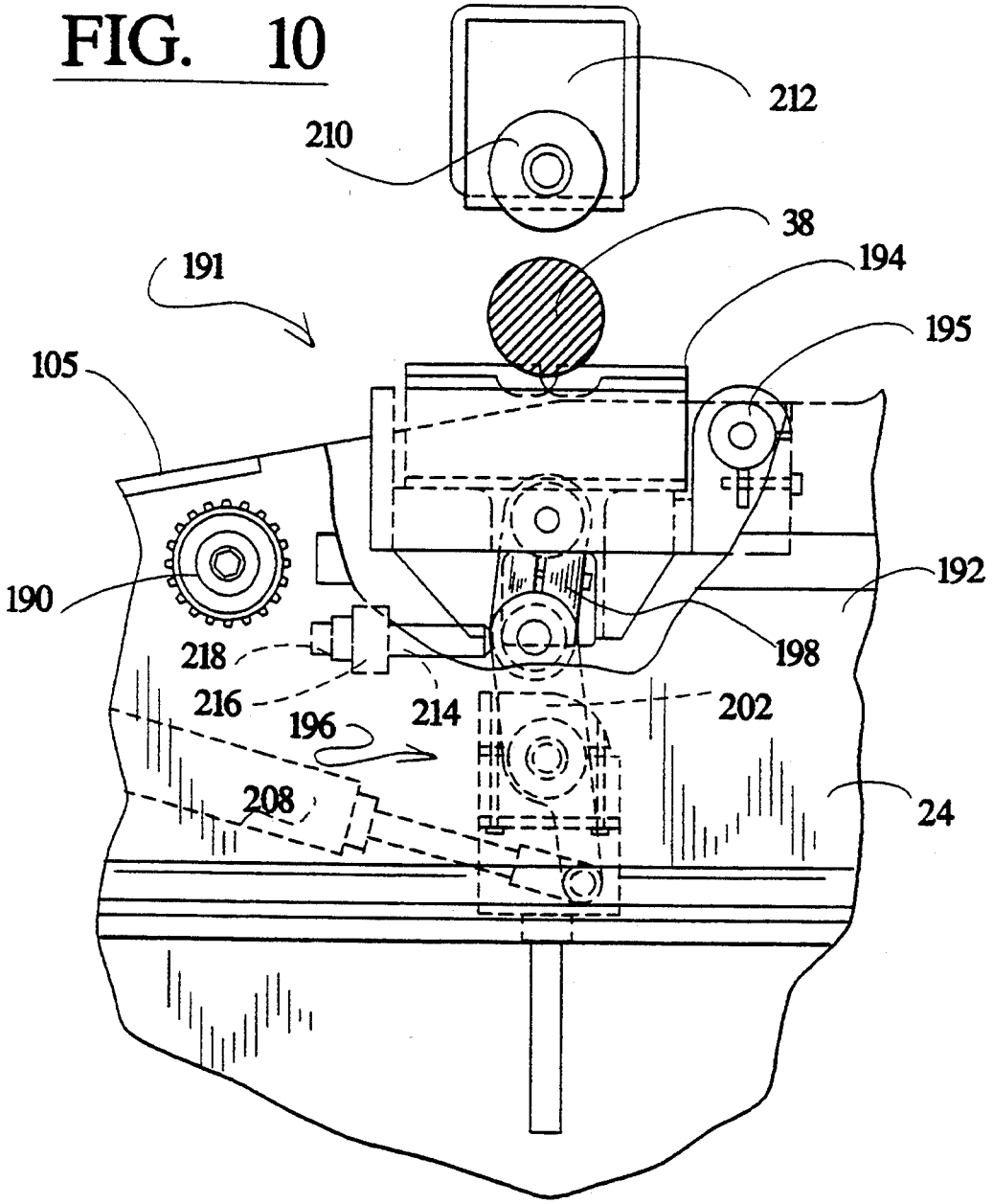
FIG. 10 is a partial, cross-sectional view, similar to that shown in FIG. 7, but showing the core shaft mounting assembly for the gear side end of the center core shaft of the running roll.

The ends of the center core shaft 38 are similarly mounted for rotation in the paster 22. Specifically, each end of the shafts 38 is supported by a fixed core shaft holder assembly 191 that is mounted on the paster near the inside-facing surfaces of the side walls 24 and 26. Each assembly 191 includes a housing 192 supported on the side wall and located between the side wall and the adjacent guide 178. The assemblies 191 are structurally and functionally similar. Accordingly, only the assembly 191, adjacent the operator side (as shown in FIGS. 7 and 8), will be described in detail, and the same reference numbers will be used for the same components in the assembly 191 (see FIG. 10) mounted on the gear side of the paster.

More specifically, a pair of spaced apart, side-by-side rollers 193 are mounted for rotation in a support bracket 194 in the assembly 191. The axes of the rollers 193 are parallel to each other and to the axes of the center core shafts. Like the rollers 184, the rollers 193 are normally disposed horizontally and are spaced apart sufficiently that the shaft 38 (or at times, the shaft 36) may be supported for rotation therebetween as shown in FIG. 7.

To assist in assuring that the shaft 38 stays supported on the rollers 193, during the unwinding of the roll 32, a stationary roller 210 is mounted above the shaft 38 and the rollers 193 at each end of the shaft 38. These rollers 210 are mounted for rotation on a flange 212 that is connected with the adjacent side wall.

The end 195 of the bracket 194, which is adjacent to the entry end 30, is pivotally connected with the housing 192 so that the bracket, and thus the rollers 193, can be moved between their normal horizontal position and a substantially vertical position. As best illustrated in FIGS. 7 and 8, the bracket 194 is supported in its horizontal position by an over-the-center toggle sub-assembly 196. This sub-assembly comprises a first pair of spaced apart members 198 which are connected, at their one ends, with the bracket 194 near its midsection, as viewed in FIG. 7. The other ends of this first pair of members 198 are pivotally connected with the one ends of a second pair of members 202. These second members 202 are, in turn, connected at their other ends with a cross shaft 204. One end of an actuator arm 206 is secured to the shaft 204 adjacent its midpoint. The other end of the arm 206 is connected with the rod end of a conventional double acting fluid cylinder 208 which, in turn, is supported at its other end by the paster 22. The operation of the cylinder 208 is controlled by the paster control circuitry.

A threaded bolt 214 extends through a thread bore in a member 216 that is secured to the side wall. A projecting end of the bolt 214 is disposed adjacent to the joined ends of the first and second members 198 and 202 when they are in their upright positions, as shown in FIGS. 7 and 8, and serves to limit the degree that these joined ends can rotate toward the exit end 34. A threaded nut 218 permits an adjustment of the length of the projecting end of the bolt 214.

Starting from the positions shown in FIGS. 7 and 8, retraction of the cylinder 208 causes a counter-clockwise (as shown in FIG. 7) rotation of the cross shaft 204 and thus the members 202. Such counter-clockwise rotation of the second members 202, causes the bracket 194 to pivot downwardly, about the end 195, so that the rollers 193 are moved to their generally vertical position. When the rollers 193 are so moved, the shaft 38 may then slide or drop forward out from between the rollers 193 and down the incline ramp 105. As noted above, the discharge shoot 106 is at the exit end of the ramp 105 and serves to catch and hold the shaft 38 for later removal from the paster.

After the shaft 38 has been thus removed from the operating position, the roll transfer drive assembly 104 moves the shaft 36, and the accompanying new roll 28, to the operating position. Thereafter, the cylinder 208 is extended so that the members 198 and 202 are returned to their vertical positions, as shown in FIG. 7, so that the bracket 194 and the rollers 193 resume their horizontal position and so that the rollers 193 support the ends of the shaft 36.

After the shaft 36 is supported by the rollers 193, the paster control circuitry actuates the cylinders associated with the brackets 186 so as to move the brackets and the rollers 186 from their horizontal position to their vertical positions. When the brackets 186 are thus moved, the rollers 184 no longer support or contact the shaft 36 and the carriers 174 (as well as the assembly 42) are ready to be moved from the operating position to the splicing position.

Figure 15:
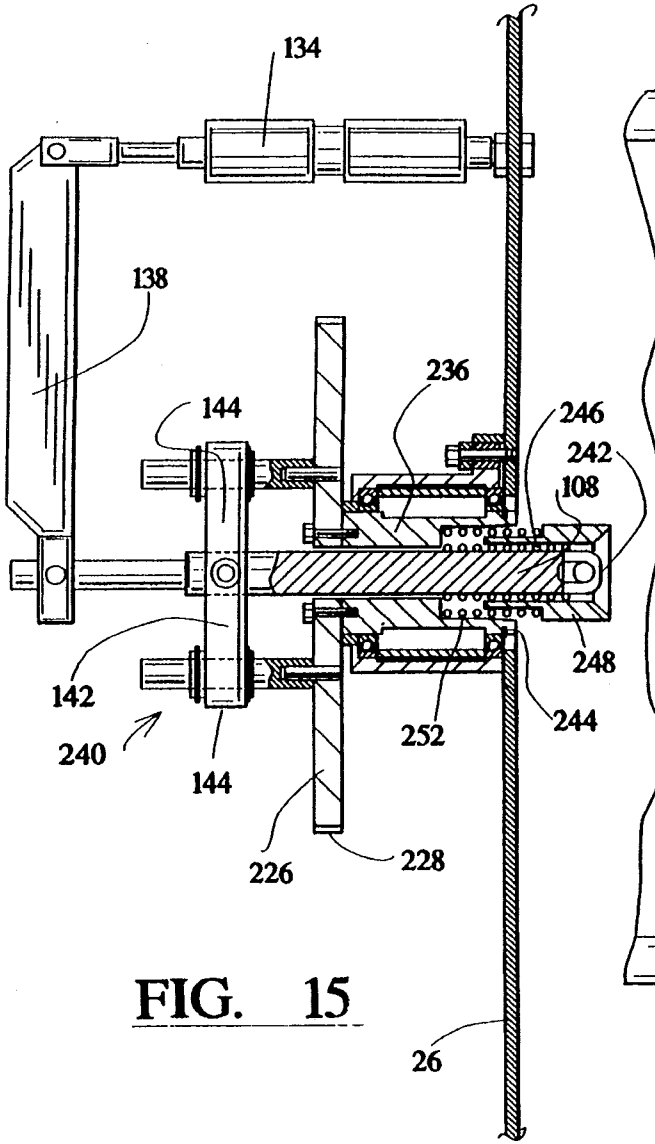
FIG. 15 is a partial, cross-sectional view taken along the line 15—15 in FIG. 14.

The fixed brake and brake accelerator assembly 44, as shown in FIGS. 14 and 15, is mounted on the operator side, side wall 26 and includes a conventional AC brake accelerator electric motor 224. As noted above, the horsepower of this motor 224 may be quite small, as for example, one horsepower, because in the paster 22, a delay in accelerating the assembly 44 up to web running speed does not present a problem due to the fact that during this acceleration, the running web is always under the control of the movable assembly 42.

The assembly 44 also includes a conventional brake disc 226 which has been modified by machining a plurality of conventional spur gear teeth 228 about its outer peripheral edge. These teeth 228 are adapted to mesh with a spur gear 232 mounted on and rotated by the output shaft of the motor 224. A conventional double caliber brake mechanism 234 is mounted adjacent to the side peripheral edge of the brake disc 226. The brake disc 226 is mounted on a conventional brake hub 236 which is substantially identical to the hub 124. As noted above, the spindle 108, like the spindle 52, rotates with the brake disc 226 and may additionally be moved, in a direction parallel to its longitudinal axis, between a retracted position and an extended position.

A sub-assembly 240 which causes such longitudinal movement of the spindle 108 is similar in construction and operation to that used to move the spindle 52. For that reason, a further description of this sub-assembly 240 is not believed to be needed and similar reference numerals have been used to identify the similar parts.

The distal end 242 of the spindle 108 projects through a circular opening 244 in the side wall 26. The distal end 242 has a drive pin which is adapted to fit in the notches 40 in the ends of the shafts 36 or 38. Like the spindle 52, the spindle 108 is biased by a coil compression spring 246 to its extended position. The distal end 242 of the spindle 108 may also include an annular collar member 248 which is likewise spring biased away from the hub 236 by a coil compression spring 252. The collar facilitates connecting the distal end 242 with the notched ends of the shafts.

The paster control circuitry includes a Motorola microcontroller chip, identified by the Motorola No. 68 HC 11 D 3, and manufactured by the Motorola Corporation of Schaumburg, Ill. This chip is used with a printed circuit board having conventional components. The following copyrighted programs (that is, the RTX/PLC program HEX file, application program HEX file, and ladder program HEX file and PLC interpreter source code file) are used by the paster control circuitry to control the paster 22:

RTX/PLC Program

HEX file

```
:10F0000000D200C77EF1907EF3BB7EF4157EF5F64C
:10F010007EF5C[illegible]EF5D37EF5DE7EFC107EFC297E6E
:10F02000FCFE7EFA2B7EF094200286110F7F002DCD
:10F030007F00081409011657575757578D11CE02BC8F
:10F040008D2016C40F8D07CE07D08D1620DE142D0F
:10F0500008CE00968D0C152D08CE015E8D045A2623
:10F06000ED39188FDC0EC307D0DD16868097231389
:10F070002380FC188F0926EA39A600AB01AB028871
:10F08000AAA103398620973C8606973F86009724DD
```

```
:10F09000860097268E00C7864097259724CCFA2BAA
:10F0A000DDFA0784BF06CC9E10FD9E00CCF02ACE70
:10F0B00000DCED0008088C010026F7CCFA2BDDFA05
:10F0C000CCF3DCDDF6CCF1EEDDFCCE004086FFA714
:10F0D00000088C00DC26F84F5FFD9000FD9002CE0A
:10F0E00090008D95270CCEA0008D8E2705862 1BD22
:10F0F000F02CDFC81AEE06272C18E600174C27253F
:10F10000CDEE056F036F04E700261418EC038300AF
:10F1100009ED018F18EC01ED084F5FA701ED02C664
:10F1200007183A20D4DEC8AB11A00D97D9EE0CC653
:10F130000108E7004A26FA4F5FDDCADDCCDEC8E6EB
:10F140001227 23188F4FD6D9E30CC30001DDCACE96
:10F1500000CAEE00C30008ED00180926F51AEF00FA
:10F16000DEC8EE04AD007F00D27EF16C4FDEC8EE4B
:10F170000A7F00D38E00C7C67FD7D6C6050E4C3A8D
:10F180006D0026FA0F97D6DFD797D3DFD4AE013BB9
:10F19000 5D260F0F7A00D226F696D327F2DED42012
:10F1A000EC16DEC8EE0C3A5F0FA6002A015CE70001
:10F1B0000E162ADF5086BF373686053DDEC8E30AC5
:10F1C0008F320FA400A70032260991D62C0597D6BE
:10F1D000DFD70F7A00D226B796D3260730A6029142
:10F1E000D62FACDED796D61F00FF9E7EF1717C0035
:10F1F000D2DED4AF0118308E00C70ECDEE07E60088
:10F2000008CDEF0758CEF2103AEE0018EC016E0070
:10F21000F1D2F226F1A1F244F25EF263F278F294B6
:10F22000F2BCF2BEF360162602D6D3DEC8EE0E3A6A
:10F230000F6D002B07271F96D340A700DED41C00BC
:10F24000407EF1D316260AD6D3DEC8D6D3EB0FE024
:10F250000DDEC8EE0C3A86010FA7007EF1D3867F43
:10F260007EF1B75D2604DED4200886053DDEC8E3C6
:10F270000A8F1C00807EF1D25D2608D6D3DED4D75B
:10F28000DA200AD7DA86053DDEC8E30A8F1C0001C2
:10F290004F7EF379375A86073DDEC8E3068F[illegible]03CD
:10F2A0008300091 88FEC01EE0518ED084F5F18A7D1
:10F2B0000118ED02188FED014F7EF1C286FF4C362A
:10F2C0005D2609DED496D318A702200886053DDE08
:10F2D000C8E30A8F18E602373C18A601260918A6CB
:10F2E00002DEC8AB0FA00D3618EC032B024F5F37C0
:10F2F0003618EC032A05435025014CCE00CC0F1ADA
:10F30000EE00271BCDA3022D0718A302EE0020EF6D
:10F31000373618A302435025014C18ED022002375E
:10F3200036EC003736DCCAED00188F18EC00DDCA69
:10F33000323318ED00323318ED02323318ED043356
:10F3400018E707383218A706324D27037EF2511C02
:10F350000040DEC8EE0C3A18A60640A7007EF1D2A7
:10F360005D2602D6D3DDD94F186D04270C96D92619
:10F370000896DADEC8AB0FA00DD6DACE00CC0F1A95
:10F38000EE00273418E1062704EE0020F24D270591
:10F3900018A10726F437363CDEC8EE0C18E6073A0B
:10F3A0008601A7003818EC00ED00DCCA18ED001843
:10F3B0008FDDCA32334D27C77EF1D25F3F01DECCED
:10F78000D0183A7EF7EDC63518DED0183AC6017E9D
:10F79000F7F686327EF02C09141E2B374450667023
:10F7A000DED03218A4000743A74020C3DED03218B1
:10F7B000A40007A740200CDED03218A4000743A401
:10F7C00040A74020AADED03218A40007A440A740DA
:10F7D00020F1DED03218A4000743AA40A74020E35E
:10F7E000DED03218A40007AA40A74020D633DED0CE
:10F7F000A640850427 0518EA0020045318E40018E1
:10F80000E70020BF33DED0A640850426E920B433CC
```

```
:10F81000DED0A640850426E320A9070E2543504FDD
:10F820005lDED03233ED41209ADED0C6FDE435E71B
:10F83000353233E341ED4128EEC602EA35E73520A3
:10F84000E6DED0C6F1E435E735EC4118381AEF486A
:10F85000A348ED4125E32704C60820DFC60420DBCA
:10F86000DED0EC4118381AEF481AA34820E67EF79C
:10F870009238DED0EC4118ED0020AC0A16D4D33E0D
:10F880001F719DCECDDED0A6408504270538387E79
:10F89000F6A930EC00E302183818388F7EF6A9DE9E
:10F8A000D0E640C504277333374FBDF7105318E433
:10F8B0000018E7003332112762365C20EBDED0E619
:10F8C00040C50427556F48335C374FBDF710DED075
:10F8D0003718E4006D483226094318A40018A70021
:10F8E000200618AA0018A700E748333211272C3643
:10F8F00020D6DED0E640C50427204F5FED413233ED
:10F9000036374FBDF71018E400CBFFDED0694269EF
:10F910004133321127053 65A20E738387EF6A9DE02
:10F92000D0E640C50427F3EC41ED4833374FBDF72F
:10F9300010DED06648664925095318E40018E70030
:10F94000200618EA0018E70033321127CE365C2073
:10F95000DB7EF792B8039CD1DED04F3318381AEF14
:10F960004A3705C3004CD3D0ED483317545454CB19
:10F970002018DED0183A16C407CEF7233AA600DBC8
:10F98000D0E640C504265418A5002636E647273A97
:10F990002A0F183CC608183A18A50018382634C68D
:10F9A0000136183C4F1AEE4818E3002403CCFFFF41
:10F9B00018ED001AA34A183832250716 18EA00185D
:10F9C000E700C608183A6D472B094318A40018A78A
:10F9D000002035 18AA0018A700202D165318E4009F
:10F9E00018E700183C1AEE48186F00186F01183815
:10F9F00020D0333818DED018A6408504270A4F05DA
:10FA0000C3004CD3D08FED00387EF6A9DED06F4016
:10FA10004F3305C3004CD3D08F32331AA30022E8F2
:10FA2000DED08604A74020E07EF792308E009F3C17
:10FA30007F006ECC300C972BD72DCEFB7CBDFB7599
:10FA4000383C8FBDFB4417EDFB44BDFB5ECE004080
:10FA5000BDFB5E863EBDFB56BDFB3824FB814C27BB
:10FA600004816C26088601986E976E20C6811A263E
:10FA7000037EF094810D2720813F27B78108260B54
:10FA80008C004027D309BDFB5620CD8C006027C8D1
:10FA9000BDFB56A7000820C08FC040CE00408D5649
:10FAA0004A2B4A3618DF628D4D18DF60324A2B34FC
:10FAB0005FC40F2612BDFB5E9662BDFB449663BD1C
:10FAC000FB44863ABDFB56C40326058620BDFB5683
:10FAD000DE62A600BDFB449C6025037EFA4D08DF74
:10FAE000628F20CDDE629661A7007EFA4D18DF603E
:10FAF00018DF627EFAB04F18DE607F00607F006121
:10FB00005A2A013937E60008CA20C1302522C167C8
:10FB1000241EC13A271A2502C007C40F37DC60052E
:10FB2000050505D76133DA61DD60188F4F3320D0CA
:10FB3000C13A27014C4C3339962E48484824049644
:10F3C00027F9EC022EF5EC00DDCCDCCAED00DFCA3B
:10F3D000EC06EE042A023F093F0220E28640972510
:10F3E000DE4008DF40DECC2709EC02830001ED029D
:10F3F00027013B7D00D2260C7D00D32707DED4AF4A
:10F40000018E00C77C00D20EDEC8E6132704EB0F86
:10F41000E00D7EF190308F8300658F3509DFCE6F70
:10F4200042B6280084CF8A60A743CCF4CCDDDC15FB
:10F43000080314090215090186309 72B8600972CC2
:10F440008626972DCC9F02FD9F005F3F016D012610
```

```
:10F450000818CE00406F022010C60FE40258CB46B9
:10F4600018DECE183AA6022B04C6022019482B0437
:10F47000E6032003E6015ACDEE003C482A043ACDCB
:10F48000EF001838DECEA602E7013A183A85402789
:10F490000F180909A60318A7005A26F56F01200BBB
:10F4A00018090918A600A7025A26F5A64484F0A751
:10F4B00044860FA1012502A601AA44A744862E97DF
:10F4C0002D86FF972F86AE972D7EF44A962EDECEA0
:10F4D000E6422A62482503962F3BC1802609D72F92
:10F4E0006F428626972D3B5C2606A6436F45201E5D
:10F4F0005C260DA64416C40FC10F27126A42200EC7
:10F5000018DECE50183A5AE101222318A600972F90
:10F5100018FE9F0018A7001808188CA000260418D1
:10F52000CE9F0218FF9F00AB45A7456A423B8681EC
:10F53000A742A64520D8851027035FE742850E27FE
:10F5400009962F6F428626972D3B962F18FE9F0017
:10F5500018A7001808188CA000260418CE9F0218BF
:10F56000FF9F005A2A08A14326D9A7452023261029
:10F57000A744840FA701810F27026C42A644200DE7
:10F5800018DECE183A5AE101220A18A700AB45A7A7
:10F59000456C423BA14526AB86FFA7427D00D226A3
:10F5A0000C7D00D32707DED4AF018E00C77C00D2CC
:10F5B0000EDEC8E6142704EB0FE00D7EF190CC4E72
:10F5C00020D316DD16DED06C4315237F3B8300016C
:10F5D0007EF7105A4F05C3004CD3D0188F39DED0B8
:10F5E000EC301AEE32CE3000A700E702188FCE348E
:10F5F00000A700E70239308F8302008FDFD018CEDA
:10F6000002014FA70008180926F9DED0C601E73528
:10F61000CCF5BEDDEE142280DD16DEC81AEE08A69B
:10F62000002A0586317EF02C18EC04DED0ED30CEB9
:10F6300030001C01041C0304A700E7021D01041D87
:10F640000304A700E7021C01041C030418EC06DEF7
:10F65000D0ED32CE34001C01041C030[illegible]A700E702E5
:10F660001D01041D0304A700E7021C01041C030480
:10F67000BDF5DECE3400A600E602188FCE3000A61F
:10F6800000E602DED0ED301AEF325F0FA643E7430B
:10F690000EA744AB45800A25035C20F98B0AA745D9
:10F6A000E746DEC8EE08E6003AEC002BC385F027FB
:10F6B0005885C0272E817025151AEE020808080803
:10F6C0003C183C37CEF8E4163AE6003A6E001AEEE3
:10F6D00001C6033A3C183CCEF7DA851027E9CEF88C
:10F6E0002B20E408083C81302409EDF71037CEF701
:10F6F0008F20D4364F05C3004CD3D0188F328B10D7
:10F70000CDEE003CCEF7DA20BE083CCEF72B20B77A
:10F7100037045454 18DED0183A33C407CEF7233ACE
:10F72000E60039010204081020408000C140A202D44
:10F73000324247535E5D5CDED0A64038367EF6A985
:10F7400018DED0383218AA4018A7407EF6A918DE75
:10F75000D0383218A44018A7407EF6A9DED0A644BF
:10F760002004DED0A646E640C50426014FA7473850
:10F770007EF6A9DED086FF20EDC60137C63518DE3D
:10FB40002F847F3936444444448D0332840F8A30F5
:10FB5000813A25028B277D002E2AFB972F397D[illegible]C5
:10FB60006E2604860A8DEF860D20EB810D26048D0E
:10FB7000ED20028DE1A600084D26F0390D504545D7
:10FB80004B45522F504F4B45523A0D2024242424EC
:10FB90002020202020206469737 06C6179206C6FB4
:10FBA00063617 4696F6E0D20242424242E24242480
:10FBB00024206469737 06C6179207 2616E67650DD1
:10FBC00020242424243A2424202020737 46F726576
```

```
:10FBD0002062797465206174206C6F636174696F51
:10FBE0006E0D207573652053554220286374 6C2D6B
:10FBF0005A2920746F2072657374617274207274 54
:10FC0000780D6E6D6920636F6E7465787420400 0A6
:10FC1000BDFC505F18CE003FBDFCCF24051809265F
:10FC2000F739A700085C2AEC39BDFC505F18CE00FC
:10FC30003FA600BDFC632405180926F539BDFCCF9D
:10FC40002405180926F739A10026ED085C2ADE39BB
:10FC50001500801426801426801400201400201 41F
:10FC60000080393C3736368F581500808D12332589
:10FC70000914268014268 08D070C8D3132333839D3
:10FC80008608150020592505150080200414008 0E1
:10FC90000114002014002 04A26E8150020152680B3
:10FCA0001526801526801400209600493914002 05E
:10FCB0001500801426801426801500201500201 4BD
:10FCC0000020140020150080150080140080393CAD
:10FCD000378F0D591500801500808DA425038D06E2
:10FCE0000C8DCA3338398601150020150020150007
:10FCF0002014002014002 0D600594924EB390F1598
:10FD00000820972A21FE21FE21FE21FE21FE017DF1
:10FD10000029972A21FE21FE21FE21FE1408202120
:10FD2000FE21FE21FE21FE21FE7D002921FE21FE75
:10FD300021FE21FE21FE21FE21FE15082001972A29
:10FD400021FE21FE21FE21FE21FE017D0029972AB0
:10FD5000962A21FE21FE21FE140820D629D62A0E3D
:10FD600039DEDCC6013C303C1AEE09FE9E0096D21C
:10FD7000ED001AEF0218381AEF0418FE84E01AEFAB
:10FD800006C6083A8C9F002503CE9E10FF9E0038C1
:10FD90006E00DEDEC60220CDDEE0C60320C7DEE256
:10FDA000C60420C1DEE4C60520BBDEE6C60620B5DB
:10FDB000DEE8C60720AFDEEAC60820A9DEECC609E9
:10FDC00020A3DEEEC60A209DDEF0C60B2097DEF2F1
:10FDD000C60C209 DEF4C60D20F8DEF6C60F20F228
:10FDE000DEF8C61020ECDEFAC61118FE9E0018E7F9
:10FDF000006E00DEFCC61220D9DEFEC61320D3CE74
:0DFE0000F084C61420CCCEF084C61520C5B9
:10FFD600FD61FD92FD98FD9EFDA4FDAAFDB0FDB656
:10FFE600FDBCFDC2FDC8FDCEFDD4FDDAFDE0FDE69B
:0AFFF600FDF3FDF9FDFFFE06F084A7
:00000001FF
```

Application Proc : Hex File

```
:10A0000001000 1A8A06CA017B80081FB823B82432D
:10A01000824F04010300C100F00787 J20001A303
:10A020006C87DF820500F00A87AF820A00A43086C1
:10A03000AF820F01A9B5867F821401A9A0864F8245
:10A040001900AB5C861F821E00A72D85EF822300BE
:10A05000B0E185BF822800A193858F822D00B19742
:10A06000855F823200F00D852F8237FFCCA0D6DDD0
:10A07000E44F5FFD8080142480CCA0E3DDF4CCA00D
:10A08000F2DDF2CCA10CDDF08625972186079723 1F
:10A0900097224F5FFD2C00FD3800FD3C00B78094F7
:10A0A000B780954FC608D7509751975297539754FA
:10A0B00097559756975 7CE8000BDF019CC9020FD4C
:10A0C000901039FE9010ED0008088C9CFF2503CEFF
:10A0D0009020FF9010397C808126037C80808680D0
:10A0E00097253B8D5718FF80A8145640C607860455
:10A0F000202CDE40FF80A08D43FD80A6FF80A418A9
:10A10000FF80A2145680C60786022012DE40FF8020
:10A11000AABDA13CFD80AC145620C6088601972339
:10A12000FEF0006D00260D6D0127091AEE0218AF32
:10A130000 1BEF0026C000ECB087EF004F620002B6E
```

```
:10A140000A18FE8086183A18FF80864FF62400FE13
:10A15000808AF3808C240408FF808AFD808C398DEE
:10A16000127EF0168D037EF016BDF01018EA00186E
:10A17000E70039BDF0105318E40018E70039BDF0CE
:10A180001018E40039BDF013CDEF0039BDF013CD48
:10A19000EE00394F5FDD40FD8084FD8086FD8088C4
:10A1A000FD8090FD808AFD808CFD808EFD8092FD7B
:10A1B00081B8FD81BAFD81BCCC00F4FD80828600AF
:10A1C000C600CE007A3F08869FBDF01F0404040439
:10A1D00004048301FFFD80DA86CFBDF01F04040470
:10A1E000040404FE801A18CE8190BDB42AFC81912B
:10A1F000FD806CCC0034BDA18C274C09260815507D
:10A200000414500820380926081550081450042 05A
:10A210002D09260515500C202509261AFC803CFD29
:10A2200080B8FD80F2FC803EFD80BABDB169FC8043
:10A23000F6FD80BE2008092614BDB1092000CC001F
:10A2400034CE0000BDA185CC0032BDA18C0926050D
:10A250001452802003155280092605145380200 3D0
:10A260001553800926051453C020031553400926B1
:10A270000514558020031555800926 1E1550041419
:10A2800050084FFD2C00B78095CC0032CE0000BDA9
:10A2900C185CC00B5BDA169203209261E15500448
:10A2A0001450084FFD2C00B78095CC0032CE000032
:10A2B000BDA185CC00B5BDA169201109260ECC0138
:10A2C00083BDA16486FFFD2C00B7809596529A53FA
:10A2D0009A55270486093F04FC81B826037EA369AA
:10A2E0005A2613FC81BA1A8301812405BDA1692075
:10A2F00072BDA15F206D5A2613FC81BA1A83018 1B9
:10A300002405BDA173205CBDA16420575A260BFC17
:10A310008 1BAFE81BCBDA18520495A2612B681BDF5
:10A32000F681BB2605FD38002039FD2C0020345A6B
:10A330002608860198509750202 95A260ACE800078
:10A340000FBDF01C0E201C5A26060FBDF022201354
:10A350005A2609B681BA0FBDF02820075A26040FE5
:10A36000BDF0257F81B87F81B97EA1BE1408281574
:10A3700008101409381509048650972886 00C6006D
:10A38000CE00023F080FBDA13CFE8080DC0E2B06F4
:10A390007D00252A0108FF80CCFD80CE868FBDF090
:10A3A0001FFD80DC86043F0420D2FE808C3C8FB3EE
:10A3B000808EFD809238FF808ECC00BFFE8092267A
:10A3C00005BDA1732013BDA169FE8092BC807425D8
:10A3D00008CC00C2BDA1732006CC00C2BDA169FE9D
:10A3E00080863C8FB38088FD809038FF8088FE8017
:10A3F0008408FF8084CC004ABDA17E26201257200D
:10A400001C15514012578018CC00C3BDA1731551C3
:10A41000801257 4014CC00BEBDA1732012145140CD
:10A42000CC00C3BDA169145180CC00BEBDA1693967
:10A430004F5FFD80D8FD80D6FD80DAFD80B88602B2
:10A440003F0786003F05FC80821A93402A09C3001B
:10A45000F4FD8082BDA3AA965384C081C02603BDAB
:10A46000B0174F5FB380DC040404040404B380DA43
:10A47000FE80D2270E2B07FB803689002005F08056
:10A48000368200B380202A09FB803789002A092000
:10A4900009F0803782002A024F5FFD80D0FE80B82D
:10A4A0002609CC0034CE0004BDA185FC80CDB3804C
:10A4B000D6FD80E0FC80D0B380D8B780E22A054387
:10A4C00053C30001FD80DCF0803582002408FE804B
:10A4D000E0BC8030252E4F5FFD80D2FD80DE18CE9F
:10A4E00080DCFE80E0BDB49BFC80DD7D80E22A053F
:10A4F0004353C30001FD80D2FC80CDFD80D6FC809B
:10A50000D0FD80D8861F945097504F5FFE80D02B8F
```

```
:10A510000BBC8022250D8620C67F2007BC8024240A
:10A52000028640493637FC808CB380CA2B09FE80F6
:10A530008CFF80CAF0803433324685E027028A10CF
:10A540009A50975084E027074827414F7EA618FC71
:10A5500080CDB380D42B35FE80D018CE80DCBDB446
:10A560002AFC80BCF380DEFD80BCFC80BAF980DD73
:10A57000B980DC2B0B8FBC80BE2508FE80BE20037B
:10A58000CE0000FF80BAFC80CDFD80D4CE0000FC60
:10A5900080BAFD80DE2A0109FF80DCCC0191BDA1DB
:10A5A0007E2712FE80DCFC80DEF38050240408FF4E
:10A5B00080DCFD80DEFC80D2FE802E18CE80E0BDE7
:10A5C000B42AFC80E1F380DEFD80DE8600F680E0C8
:10A5D0002A014AF980DDB980DCFD80DCFC80D0CE28
:10A5E0000000FC80D02A0109F380DEFD80DE8FF9B7
:10A5F00080DDB980DCFD80DCFC80DEFE80B818CE1A
:10A6000080DCBDB42AFC80DC2B072609FC80DD2021
:10A61000074F5F2003CC00FF8D3B86019550273 20A
:10A62000FC80CDBDA0C3FC80CABDA0C3FC8086BD9C
:10A63000A0C3FC80D0BDA0C3FC80D2BDA0C3FC8061
:10A64000BABDA0C3B68094F68095BDA0C3DC50BD52
:10A65000A0C37EA4421713500C1C1350080B1350B8
:10A66000040E44FD3800B78094FD2C00B780953966
:10A67000FD3800B78094393C8FB3810838FF8108DA
:10A68000135010041550103 9FE811EFD811EFC81EF
:10A690001CFF811CFE811AFD811AFF8118274CF3D3
:10A6A000811AF3811CF3811E0404FE800818CE81F8
:10A6B00028BDB466FE8000BDB49BFC812A1A8303CA
:10A6C0000024281A8300202522FD8120B381222A1C
:10A6D000054353C30001B38048250CFC8120FD8154
:10A6E00022FD80F0BDB109860B3F04391355013CB2
:10A6F000[illegible]508014FE812408FF81248C0002252C36
:10A70000FC813AB3810C2524CC0184BDA164CC0129
:10A710008DBDA164CC004EBDA169CC0032CE00003D
:10A72000BDA185CC00B5BDA169145501394F5FFDB0
:10A730008106FD8108FD810CFD810AFD8118FD81E6
:10A740001AFD811CFD811EC6003F01135620F8151D
:10A750005620FC80AA3736B381061AB38012240330
:10A760003820E4FE810CFF8126FD810C38FF810634
:10A77000FE810A08FF810AFE80AC13558005BDA644
:10A78000EC20C4135008C0BDA67720BBB381361A95
:10A79000B380142523FE813C8C00022515FE814EDA
:10A7A000FD814EFC814CFF814CFE814AFD814AFFB8
:10A7B0008148FC80A2FD813639B38136FE8136277F
:10A7C000F7FE8156FD8156FC8154FF8154FE815273
:10A7D000FD8152FF81503918FE813C188C00032402
:10A7E0000ECCFFFFCE00FFFD8168FF81662019B30C
:10A7F00081388FF28137B28136FD8166FC817CFF22
:10A80000817CB3817CFD8180FC80A6FE80A4FD81DB
:10A8100038FF813615530FFC81662612FC817C1AA5
:10A820008320002409FC813A1A8302DC250FCC3FE7
:10A83000FFFD81677F81667F81847EA8DD4F5FFD9C
:10A840008166CC5000FD8168FE809218CE8166BD85
:10A85000B49BFC816826015C05055CFD8182125178
:10A86000201CFC817CB38174FD81662A054353C39F
:10A870000001B381822A267D8184135180221551E3
:10A88000E096542B1B868097548605C600CE0000A8
:10A890003F0A86053F0720087C818420037F81844E
:10A8A000FC8166053736FC813AFE817618CE8166DA
:10A8B000BDB466FC8167FE813ABDB466FE81674F18
:10A8C000335D2A014AFD81665F32FD81688FF38125
:10A8D00068FD81682407FE816608FF8166FC816748
:10A8E000BDA0C34D2B1CFE817818CE8166BDB46619
```

```
:10A8F000CC0183BDA15F4FFD2C00B780951453029E
:10A9000020324353C30001040404FE813A8C01E861
:10A9100025074F5FFD8168201BFE817A18CE816676
:10A92000BDB466CC0183BDA1648620FD2C00B78038
:10A9300095145301FC8168BDA0C3FC81682729FEE2
:10A9400081662636BDB4F0FD81661AB3813A242AA9
:10A950008606C600CE00003F0A8606C600FE816657
:10A960003F0986063F072012CC0183BDA1644FFD3D
:10A970002C00B78095155303200096 53D654BDA0E4
:10A98000C3FC813ABDA0C3FC817CBDA0C3FC818017
:10A99000BDA0C3FC8182BDA0C3FC8166BDA0C3393C
:10A9A000C6003F01CC0183BDA1644FFD2C00B780E0
:10A9B0009586003F0696542B12CC0189BDA164CC2C
:10A9C000018ABDA1647F00547EAAF9857C264AFCD9
:10A9D000815CFE800018CE8190BDB466FE813ABDD8
:10A9E000B49BFC8192FD818C8FFC815EFD8190BDCA
:10A9F000B49BFC8191FE8062BC813A2503FE813AC2
:10AA0000FF8190B38190B38016FD818E2A05F3817A
:10AA10003A2BFB1454407EAAFD1354404115544078
:10AA2000145420CC0189BDA15FFE818CFC815EF3B2
:10AA30008064362A054353C30001FD819018CE81FE
:10AA400090BDB49B32B78190FC81917D81902A05A5
:10AA50004353C30001B38018B3818E7EAAFD13540
:10AA600020581554201454 10CC018ABDA15FCC018C
:10AA700089BDA164CC00C1FE8120BC807A2405BDC3
:10AA8000A1692003BDA1731550081450044F5FFD48
:10AA90008118FD811AFD811CFD811EFC815CFD80F9
:10AAA000F0FD8122BDB10986FFFD3800B78094FC1E
:10AAB00080180505CC01007EAAFD135410241554FE
:10AAC00010145408CC018ABDA164CC0032CE000021
:10AAD000BDA185CC00B5BDA1697F0053CC00027E2D
:10AAE000AAFD1354080C155408145404FC806E7EFF
:10AAF000AAFD135404037F005486003F06FD819095
:10AB00009654F680D3BDA0C3FC8092BDA0C3FC8147
:10AB10003ABDA0C3FC818CBDA0C3FC815EBDA0C3B7
:10AB2000FC818EBDA0C3CC0000BDA0C3FC8190BD44
:10AB3000A0C38600C600FE81903F09C6003F017E8B
:10AB4000A9B512530815F38180FD8182145308FCC6
:10AB50008086BDA0C3FC8182BDA0C3394F5FFD814B
:10AB60003CFD8134FD8136FD813AC6003F0113561C
:10AB70008063155680FC80A03736B381341AB380C9
:10AB800012240338204FFD813A38FF8134FE813C86
:10AB900008FF813CCC003CBDF013CDEE0008CDEFAA
:10ABA000001352800C12520108FC80A2BDA78C2019
:10ABB00024135380131253404112540 10BFC80A6FE
:10ABC000FE80A4BDA7D7200D13500409FC813AFED6
:10ABD00080A6BDA677135640911556401352800C9F
:10ABE00012520108FC80A8BDA7B9200E1353800A99
:10ABF00013534006FC80A8BDAB427EAB6A4D2B14BC
:10AC0000CC0183BDA1644FFD2C00B780957F00521D
:10AC10007F005339847F2623FC80901AB3805C2503
:10AC2000098620FD2C00B78095391452084FFD2C61
:10AC300000B78095CC0183BDA15F3913520849FC50
:10AC40008090 1AB3805C253F1552081452404F5F24
:10AC50009756FD815CFD815EFD8160FD8162FD8115
:10AC600064FD8148FD814AFD814CFD814EFD81508E
:10AC7000FD8152FD8154FD8156FD813CDC40FD810A
:10AC800058FC8090FD815A3913524050FC80901A34
:10AC9000B3805C2427DC40B381581A8307A0251CAD
:10ACA000CC0183BDA164CC0032CE0000BDA185CC17
:10ACB00000B6BDA169CC00B5BDA169391352401CD5
:10ACC000FC80901AB380582512155240145220CCA3
```

```
:10ACD0000183BDA164BDAD6FFD8160391352201E9B
:10ACE000FC80901AB3805A24F2155220145210861 8
:10ACF00020FD2C00B78095BDAD6FFD8162391352E8
:10AD000010D9FC80901AB3805C24D07F00524FFD94
:10AD10002C00B78095BDAD6FFD816418CE8148BD14
:10AD2000ADCBFD817418CE8150BDADCBB380662A0A
:10AD300003F38174FD815EFC8174FD8166FE8000F9
:10AD400018CE8166BDB49BFC8167FD815CFC81747B
:10AD5000FE8002BDB466FC8167FD8174CC0032CEFA
:10AD60000000BDA185CC00B5BDA1697F005339FCB1
:10AD70008090B3815A2A054353C30001FD8166BD0B
:10AD8000A0C3DC40B38158DE40FF8158FE8090FFB5
:10AD9000815ABDA0C38F18CE8166BDB49BFC81676C
:10ADA000BDA0C3FE800ABDB466CE00F4BDB49BFC5A
:10ADB0008168BDA0C3FE8002BDB466FC8167BDA0F2
:10ADC000C3BDA0C3BDA0C3BDA0C339CE000018EC55
:10ADD0000018E30224010818E30424010818E3061C
:10ADE000240108FF816676816746567681674656 5C
:10ADF000FE800A18CE8166BDB466FC8167391250A8
:10AE000010034D2B11CC0183BDA1644FFD2C00B765
:10AE100080957F005339841027037EAE9914531216
:10AE2000CC0183BDA15F4F5F9756FD813CFD817CC6
:10AE3000FD8180FD8182B781849754DC40FD81587B
:10AE4000FC8090FD815A18CE8166CC0001FD81689E
:10AE5000FD8166FC8160F381628FBDB49BFC8168DB
:10AE6000FD817818CE8166CC0001FD8166FD816888
:10AE7000FC8164B381628FBDB49BFC8168FD817AE3
:10AE8000FC8162FE8162BDB466FE8168FC8178BD92
:10AE9000B466FC8167FD817639FC813C2629DC4063
:10AEA000B381581A830E4C251ECC0183BDA164CCFE
:10AEB0000032CE0000BDA185CC00B6BDA169CC009A
:10AEC000B5BDA1697F005339850126134D2B114F64
:10AED000FD3800B78094CC0184BDA1647F00553952
:10AEE000857026151455404FFD3800B780944F5F8C
:10AEF000FD8124DC40FD8158391355401DDC40B3F1
:10AF000081581A8301E82540155540145520CC017D
:10AF100084BDA15FDC40FD815839FC81242629DCF9
:10AF200040B381581A8303D0251ECC0184BDA1648F
:10AF3000CC0032CE0000BDA185CC00B6BDA169CC4D
:10AF400000B5BDA1697F0053394D2B11CC0183BDE4
:10AF5000A1644FFD2C00B780957F005339841026E3
:10AF600046145312155308CC0183BDA15F4F5F9760
:10AF700056FD813CFD817CFD817EFD8138FD818C0B
:10AF8000FD81829754155308FC8066FE800418CE1C
:10AF90008190BDB466FC8191FD8180FC814EB381BE
:10AFA00080B38004FD818018FE8086FE808CFC8149
:10AFB000382608FF817E18FF813839FC808CB381E8
:10AFC0007EFF817EFD817CFC8086B3813818FF8105
:10AFD00038FE800A18CE8190BDB466FC8191FE8057
:10AFE00002BDB466FC8191FD818CC300321AB3812D
:10AFF0007C250514530420031553048300 96B38164
:10B000007C2B057D00542708CC0183BDA15F200661
:10B01000CC0183BDA1643913530808FC8086B38139
:10B02000822A0139155308FC8086BDA0C3FC8182A9
:10B03000BDA0C39654261F1353041ACC0189BDA189
:10B040005FFC800404F38004F38182FD8182145349
:10B050000886A097543985202761155420CC018A91
:10B06000BDA15FCC00C1FE8120BC807A2405BDA1BA
:10B07000692003BDA1731550081450044F5FFD8172
:10B0800018FD811AFD811CFD811EFC815CFD80F094
:10B09000FD8122BDB10986FFFD3800B78094CC0147
```

```
:10B0A00083BDA164CC0189BDA164FC800404F3814B
:10B0B00082FD8182145308145410398510272 1CC45
:10B0C000018ABDA164CC0189BDA164CC0032CE004F
:10B0D00000BDA185CC00B5BDA1697F00537F0054A0
:10B0E0003986003F0596522705BDABFD20F39653E8
:10B0F000270E85402705BDAF4920E6BDADFE20E106
:10B10000965527DDBDAEC820D8FC804CFD80EEBD35
:10B11000B11CBDB14FBDB169BDB1843918CE80F845
:10B12000FC802CFE80EEBDB466FC80F0B3804E2A1D
:10B13000054353C300018F3CFC80F9BDB466FC801D
:10B14000F938BDB46[illegible]C80F9F3804AFD80F2391805
:10B15000CE80F8FC80B8FE80BABDB466FE80F2BD39
:10B16000B49BFC80FAFD80F43918CE80F8FC803264
:10B17000FD80F94FB780F8FE80F2BDB49BFC80FAE9
:10B18000FD80F639FC80F4FD80BAFC80F6FD80BEBF
:10B19000FC80F2FD80B8394F5FFD81A4FD8160FC29
:10B1A0008040FD819E86003F05FC8120FE800218C4
:10B1B000CE81ACBDB466FE81ADFC800018CE81B0FE
:10B1C000BDB466FE81ADFC81B104BDB466FC81B046
:10B1D000FC81B2FC81A42758FC810AB381A01AB378
:10B1E000806A255EFC81A4FE800218CE81ACBDB4CD
:10B1F00066FE81ADFC80003CBDB46638FC81AD04C8
:10B20000BDB466FC81AEB381B2FD81AEFC81ACF20F
:10B2100081B1B281B0FD81ACFC808BB381A28FBDC6
:10B22000B49BFC81AE2B091A8300402403FD819E50
:10B23000FC8120FD81A4FC808BFD81A2FC810AFDA4
:10B2400081A0FC819EFC806CFE800218CE81ACBD8A
:10B25000B466FE81ADFC80003CBDB46638FC81ADB7
:10B2600004BDB466FC81B2B381AEFD81AEFC81B099
:10B27000F281ADB281ACFD81ACFE819E18CE81AC75
:10B28000BDB49BFC81ADFD81ACB681AFB781AEFC96
:10B29000811EFE811EBDB49BFC8126F3810C043708
:10B2A00036FE81AEBDB466FC81ADCE010CBDB46688
:10B2B000FC81ADFD81A638CC0078FD81A8FC8160C1
:10B2C0002720BDB466FE81ADFC811EFD81ACBDB4FE
:10B2D0009BFE81AC3CCC010CBDB466FC81ADFD8114
:10B2E000A8388FFC81A6FC81A8FC811EFC81604FE0
:10B2F000F68071F381A81AB381A624051557802022
:10B30000051457C0201BCC005DBDA17E26184FF64A
:10B31000807 1FB807024014CF381A81AB381A625AB
:10B32000051457402003155740FE8120BC80762429
:10B3300014F681AAC1022508CC00C4BDA169200E63
:10B340007C81AA2009CC00C4BDA1737F81AAFE81A3
:10B3500020BC80782414F681ABC1022508CC00C043
:10B36000BDA169200E7C81AB2009CC00C0BDA173BA
:10B370007F81ABFE806CBC812025031451C0FE810F
:10B3800020BC801C250515512020061451E01457BF
:10B39000E07EB1A58F43538F43530826045C2601FA
:10B3A0004C394D2A24408108251236EC01ED024F1C
:10B3B000E6002A014AED0032800820EA4A2B2A677B
:10B3C000006601660266032 0F38108250F36EC0152
:10B3D000ED00A6035FED0232800820ED4A2B0A68DB
:10B3E000036902690169002 0F339861FE600261609
:10B3F0008008E60126108008E602260A8008E60397
:10B400002604868 0394A5924FC395D27F58B0720AC
:10B41000014A5924FC396F006F016F026F034D2AF6
:10B4200001396C031627FA7EB3A2363C3C3736301E
:10B43000CCB44FED04A6022A0AA806A7064F5FA3C4
:10B4400002ED02EC002A234F5FA300ED00201B3227
:10B450004D2A12183C384F5FA302ED02CC0000E2E7
:10B4600001A200ED00393C373630186F00186F012B
```

```
:10B47000A6033D18ED02A600E6033D18E30118ED12
:10B4800001EC013D18E30118ED01186900A600E682
:10B49000023D18E30018ED0038383918EC00CDEF04
:10B4A00000023CCDEE00033CCDEE0218ED0218EC9C
:10B4B000008F023C18E3028F4F5F18ED02CDAC0005
:10B4C00025088F18A300186C038F18ED003233186D
:10B4D000E30218ED022403186C01323318E302185A
:10B4E000ED022403186C01323318E30018ED003923
:10B4F00018CE0001CEB51C1AA33E2306040418087A
:10B5000020F51AA3002708230408082 0F509098F4D
:10B5100083B51C04180927030520F9390000000130
:10B52000000400090010001900240031004000 51FF
:10B53000006400790090 00A900C400E1010001212D
:10B54000014401690190 01B901E4021102400271 54
:0CB5500002A402D903100349038403C1C4
:00000001FF
```

Ladder Program H  File

```
:10B8000010000000FFFF0000000000000000000002A
:10B8100010421997 1E4311961640204220431E40A5
:10B820001E3511951640204220431E401E361194AD
:10B83000164020422 0431E401E32119316402042E3
:10B8400020431E401E3311921640204220431E40CA
:10B850001E3412431D8712351D8612421D8512BDEE
:10B860001D8411981C4611991C47119A1C4811916E
:10B870001C4912FF1E0012430412005000A61203BE
:10B880005000D312045000D912055000E5120750A1
:10B8900000EB12085000FB120950010B120A500174
:10B8A0001B120B50012B120C50013B120D50014B7F
:10B8B000120E50015B120F50016B121050017B12DF
:10B8C0001350018B121450019B121E5001AB121F1A
:10B8D0005001F9122050026512215002B11222507B
:10B8E00002C112235002CB122450032B1225500305
:10B8F0007512265003C112275003E912285003F78E
:10B90000123250040C12335004761234 5004CE120A
:10B91000355004EE123650053C10FF1E4320C72060
:10B92000405105A810001F801F811F821F831F84A4
:10B930001F851F861F8710001F881F891F8A1F8B66
:10B940001F8C1F8D1F8E1F8F10005500FE12001EB2
:10B95000FF1E4D51057610461843 1D8020035105EA
:10B960006B1047184818431D81200410471C425192
:10B97000055A104718431D81200551054F124317E2
:10B980008F71000A281F8F11001843204A20075189
:10B99000053A1243158F710005DC218F1100184301
:10B9A0001E4A2008510525124317 8E710003201FDF
:10B9B0008E11001843204B2009510510124315 8E9B
:10B9C00071000320218E110018431E4B200A5104E0
:10B9D000FB1243178C710001901F8C110018431E3D
:10B9E0004D200B5104E61243158C71000190218CFF
:10B9F00011001843204D200C5104D11243158D71B4
:10BA0000000190218D110018431E4E200D5104BCE1
:10BA10001243178D710001901F8D11001843204EA5
:10BA2000200E5104A71243158B71000190218B1138
:10BA30000018431E4F200F5104921243178B7100C0
:10BA400001901F8B11001843204F201051047D12CC
:10BA500043158A710000C8218A110018431E4C202A
:10BA60001351046812431 78A710000C81F8A11001D
:10BA70001843204C201451045312C720C820C91E5B
:10BA8000C7124E1E0D104E16C871000190218 21E65
:10BA9000C87000001414_31F827000006414C8210C
:10BAA000821EC912C9723B0000700000C81F82705C
```

```
:10BAB0003B00031E42104E14C915001E5A105A189E
:10BAC0004218431F8220C7201E51040012C720C8FD
:10BAD00020C920CA1EC7104816C81EC8124816C85A
:10BAE000164316421E0410C816C916CA1EC9218262
:10BAF000710007D010C916CA1448723B000021809B
:10BB000010C916CA16481F80703B00021ECA10C911
:10BB100016CA15001E4212CA7101001410CA17017C
:10BB2000218110CA15011E5B1F81105B184218434A
:10BB30001F801F811F8220C7201F51038F12C72023
:10BB4000C820C920B420B51EC712C8164B1E0A1241
:10BB5000C8144B1EC810C816C9723100011EC91086
:10BB6000C914B416B51E5C10C914B414B51E421025
:10BB7000431F82105C1842144B1E09105C184216B9
:10BB80004B18437231000020C7202051033E124A57
:10BB900014BF1E08104A1E5D105D184320C72021E7
:10BBA00051032910C21E5E105E184320C720225187
:10BBB000031A12C720C820B420B51EC710C1164BE7
:10BBC00016B41E0A12C1144B16B41E0910C11[illegible]330
:10BBD00016B4723100031EC812C1164B16B472316E
:10BBE00000021EC810C814B416B51E5F10C814B4E5
:10BBF00014B51E42105F1842144B1E09105F184204
:10BC0000164B18431AC2723100001F8220C720232E
:10BC100012C220225102B512C01C42124F144A1601
:10BC2000421E07124A1647144D16421E0C124A169F
:10BC300047164D164F16421E0F124A1647164D1440
:10BC40004F16421E05124A1447144F16421E101278
:10BC50004A1447164F16421E6010601842184320BF
:10BC6000C7202451026612C720C820C920B420B5BD
:10BC70001EC712C8164C1E1312C8144C1EC810C87A
:10BC800016C9723100041EC910C914B416B51E615C
:10BC900010C914B414B51E4210611842144C1E147D
:10BCA000106118421843164C7231000020C720253D
:10BCB00010431F8351021512C7723100051CB420B6
:10BCC000B51EC710C714B416B51E6210C714B4143D
:10BCD000B51E4210621842184372310000 20C7207E
:10BCE000265101E8104E1E0E124E1E6310631843BB
:10BCF00020C720275101D5104A1E07124A16461E9A
:10BD000003124A144618431E64555A6C20285101E8
:10BD1000BB124F18BE16C71E4212C71EC7104B16C5
:10BD2000421E09104A16421E07124A1647144F16A1
:10BD3000421E051047144F16421E101047164F168C
:10BD40004D16421E0B1047164F144D144E16421E30
:10BD50000E1246164F144D164E16421E031046166E
:10BD60004F144D164E20001046164F144D164E001F
:10BD700010420118431F801F8120C7203251014CFF
:10BD800010BE16C71E4212C71EC7104B16421E0910
:10BD9000104A16421E07124A144E16421E0E124A2E
:10BDA000164E164F164716421E051047144D1642E2
:10BDB0001E0C1047164D164F16421E0F1246144FFA
:10BDC00016421E031046144F20331046144F1843DA
:10BDD00018421F801F8120C720335100EF10BE166C
:10BDE000C71E4212C71EC7104D16421E0C124D161A
:10BDF0004F16421E0F104F1843184220C7203451CF
:10BE000000CA125A1E1E105A165B1E1F105B165CCB
:10BE10001E20105C165D1E21105D165E1E22105E37
:10BE2000165F1E23105F16601E2410601661 1E250B
:10BE3000106116621E2610621663 1E2710631664B8
:10BE40001E2810641843 18421F801F811F821F8301
:10BE5000203551[illegible]077105F166314BE16C71C4212BE
:10BE6000C720C820C91EC7105A16C8164271000143
:10BE7000F41EC810C816C9723100071 0C815001A80
:10BE80005A16BE7231000620B420B51EC910C9145E
```

```
:10BE90004B16421E0910C9144A16421E0710C91635
:10BEA0004F144E1E0E10C9144F144D1E0C10C916FF
:10BEB0004A164616421E0310C91446164272310035
:0DBEC000001E0010431F802036510000FFBF
:00000001FF
```

PLC Interpreter Source Code

```
; some constants
ll_frs  equ 512   ; framesize
ll_nb equ 512   ; number of bits total
ll_nry  equ 256   ; number of relays
ll_ntc  equ 128   ; number of variables
ll_nio  equ 48    ; number of ios
; ladder static variables
lv_data equ 00
lv_bits equ lv_data
lv_rlys equ lv_bits   ; relay bits
lv_tcds equ lv_rlys+ll_nry/8  ; tc done bits
lv_tcrs equ lv_tcds+ll_ntc/16 ; tc rung bits
lv_ios  equ lv_tcrs+ll_ntc/16 ; io/system bits
lv_free equ lv_ios+ll_nio/8 ; unused bits
lv_work equ lv_bits+ll_nb/8 ; scratch space for interpreter
lv_sign equ lv_work ; signal
lv_acc  equ lv_work+1 ; accumulator
lv_c01  equ lv_work+3 ; .01s clock
lv_t01  equ lv_work+4 ; .01s ticker
lv_p10  equ lv_work+5 ; .10s partial
lv_t10  equ lv_work+6 ; .10s ticker
lv_bump equ lv_work+7 ; can be tick or count
lv_temp equ lv_work+8 ; 4b for scratch
lv_eow  equ lv_work+12  ; end of work space
lv_cnts equ lv_eow    ; words of tcv counters
lv_eof  equ lv_cnts+ll_ntc*2  ; end of frame
lv_end  equ lv_data+ll_frs
lv_size equ lv_end-lv_data
lv_chk  equ lv_size-lv_eof

ll_io1  equ mm_io1  ; bases for ios
ll_io2  equ mm_io2
ll_pa equ mm_iopa ; port a data
ll_pac  equ mm_ioca ; port a control
ll_pb equ mm_iopb ; port b data
ll_pbc  equ mm_iocb ; port b control
ll_ddb  equ $04   ; dd control bit

lp_plen equ 0   ; length of prefix
lp_conf equ 4   ; config bits

; use output compare timer for .01 s increments
plc_tick equ #20000 ; 20K e is .010 s
plc_ticker
  ldd #plc_tick
  addd  ir_toc1
  std ir_toc1
  ldx PLC
  inc lv_c01,x
  bclr  ir_tflg1,$7f
  rti
; service routines
plcbit  subd  #$0001
```

```
  jmp lo_bit     ; addr, mask into y,b
plcvar  decb       ; addr in y
  clra       ; d is tc number
  asld       ; times two
  addd  #lv_cnts  ; plus offset
  addd  PLC    ; plus frame start
  xgdy
  rts
plcfor  ldx PLC    ; force outputs
  ldd lv_ios,x
  ldy lv_ios+2,x
  ldx #ll_io1    ; for pia 1
  staa  ll_pa,x
  stab  ll_pb,x
  xgdy
  ldx #ll_io2    ; for pia 2
  staa  ll_pa,x
  stab  ll_pb,x
  rts

; service routines
; main entry for task
plc_entry
;   allocate statics stack frame
  tsx      ; get starting stack address
  xgdx
  subd  #lv_size  ; adjust down for stack frame
  xgdx       ; maintain x as frame pointer
  stx PLC
; initialize static varibles
  ldy #lv_size+1
  clra
: staa  0,x
  inx
  dey
  bne :-1
  ldx PLC
  ldab  #$01     ; set mcr on
  stab  lv_ios+5,x  ; at bit 40
; start output compare ticker
  ldd #plc_ticker
  std rtxVectors+sv_tol
  bset  ir_tmskl,mr_ocli
  std ir_tocl
; initialize dd regs
  ldx applu    ; get config from prefix
  ldy apPLCBase,x
  ldaa  lp_plen,x
  bpl :+1    ; length>127 is invalid
  ldaa  #$31
  jmp flasher    ; code .. no ladder loaded
: ldd lp_conf,y ; a,b ddr
  ldx PLC
  std lv_ios,x  ; set all op hi
  ldx #ll_io1    ; pia 1
  bset  ll_pac,x,ll_ddb ; to data bits
  bset  ll_pbc,x,ll_ddb
  staa  ll_pa,x    ; for initial value
  stab  ll_pb,x
  bclr  ll_pac,x,ll_ddb ; then to dd bits
  bclr  ll_pbc,x,ll_ddb
```

```
  staa  ll_pa,x
  stab  ll_pb,x
  bset  ll_pac,x,ll_ddb ; now back to data
  bset  ll_pbc,x,ll_ddb
  ldd lp_conf+2,y
  ldx PLC
  std lv_ios+2,x  ; set all op hi
  ldx #ll_io2   ; now pia 2
  bset  ll_pac,x,ll_ddb
  bset  ll_pbc,x,ll_ddb
  staa  ll_pa,x
  stab  ll_pb,x
  bclr  ll_pac,x,ll_ddb
  bclr  ll_pbc,x,ll_ddb
  staa  ll_pa,x
  stab  ll_pb,x
  bset  ll_pac,x,ll_ddb
  bset  ll_pbc,x,ll_ddb
plc_set
; set hardware from out bits
  jsr plcfor
plc_top
; set in bits from hardware
  ldx #ll_io2   ; add ip bits
  ldaa  ll_pa,x
  ldab  ll_pb,x
  xgdy
  ldx #ll_io1
  ldaa  ll_pa,x
  ldab  ll_pb,x
  ldx PLC
  std lv_ios,x  ; in 01..16 for now
  sty lv_ios+2,x  ; in 17..32 for now
; set time tickers
  clrb
  sei
  ldaa  lv_c01,x  ; ticks since last scan
  stab  lv_c01,x
  cli
  staa  lv_t01,x  ; is .01 ticker
  adda  lv_p10,x  ; and part of .10 partial
: suba  #10   ; as long as partial has a full .10
  bcs :+1
  incb      ; then show in .10 ticker
  bra :-1
: adda  #10   ; then save rest in partial
  staa  lv_p10,x
  stab  lv_t10,x
  ldx applu   ; x is op pointer
  ldx apPLCBase,x ; start at beginning
  ldab  lp_plen,x ; length of prefix
  abx
plc_cycle
; stx temp
  ldd 0,x   ; next op
  bmi plc_set   ; >$7f is end of ladder
  bita  #$f0    ; $00..0f are one byte ops
  beq lo_1b
  bita  #$c0    ; $10..3f are two bytes
  beq lo_2b
  cmpa  #$70    ; $40..6f are three bytes
```

```
  bcs lo_3b
lo_4b ldy 2,x    ; get constant
  inx      ; bump to next op
  inx
  inx
  inx
  pshx       ; nextop is deepest
  pshy       ; data is next
  pshb       ; tc number on top
  ldx #j_4b    ; figure address of process
lo_go tab
  abx
  ldab  0,x
  abx
  jmp 0,x
lo_3b ldy 1,x    ; get whatever
  ldab  #3     ; bump to next op
  abx
  pshx       ; nextop is deepest
  pshy       ; data on top
  ldx #j_3b4     ; $4x ops
  bita  #$10
  beq lo_go
  ldx #j_3b5     ; $5x ops
  bra lo_go
lo_2b inx      ; bump to next op
  inx
  pshx       ; nextop is deepest
  cmpa  #$30     ; $3x is math t.b
  bcc lo_2b3
  jsr lo_bit     ; bit in d to addr, mask
  pshb       ; is mask, addr in y
  ldx #j_2b    ; figure address of process
  bra lo_go
lo_2b3  psha       ; stash op
  clra       ; d is tc number
  asld       ; times two
  addd  #lv_cnts  ; plus offset
  addd  PLC    ; plus frame start
  xgdy       ; leave in here for put
  pula       ; get op back
  adda  #$10     ; and make it into $4x
  ldx 0,y    ; get contents of tc
  pshx       ; to make it look like $4x
  ldx #j_3b4     ; $4x ops
  bra lo_go
lo_1b inx      ; bump to next op
  pshx
  ldx #j_1b    ; and go do it
  bra lo_go

; bit number in D, get addr and mask in y,b
lo_bit  pshb       ; 00oo oooa aaaa abbb
  lsrd       ; 000o oooo aaaa aabb
  lsrb       ; 000o oooo 0aaa aaab
  lsrb       ; 000o oooo 00aa aaaa
  ldy PLC    ; point y to byte
  aby
  pulb       ; get bit num back for mask
  andb  #$07
  ldx #lo_masks
```

```
  abx
  ldab  0,x
  rts
lo_masks db 1,2,4,8,16,32,64,128
; one byte ops:
;  stack is nextOp.w
j_lb  equ *
  db  le_push-*
  db  le_pullor-*
  db  le_push-*
  db  le_pulland-*
  db  le_time01-*
  db  le_time10-*
  db  le_countup-*
  db  le_mcr-*
  db  le_cmr-*
  db  le_btd-*
  db  le_dtb-*
  db  le_quad-*
le_push
  ldx PLC
  ldaa  lv_sign,x ; push current signal
  pulx
  psha
  jmp plc_cycle
le_pullor
  ldy PLC
  pulx
  pula      ; or saved signal
  oraa  lv_sign,y ; with current
  staa  lv_sign,y
  jmp plc_cycle
le_pulland
  ldy PLC
  pulx
  pula      ; and saved signal
  anda  lv_sign,y ; with current
  staa  lv_sign,y
  jmp plc_cycle
le_time01
  ldx PLC
  ldaa  lv_t01,x  ; is number of ticks
  bra le_tstb
le_time10
  ldx PLC
  ldaa  lv_t10,x  ; is number of ticks
le_tstb ldab  lv_sign,x ; if rung is true
  bitb  #$04
  bne le_setb   ; then save bump
  clra
le_setb staa  lv_bump,x
le_lx pulx      ; get nextop back
  jmp plc_cycle
le_countup
  ldx PLC
  ldaa  #$ff    ; is count true
  bra le_tstb
le_mcr
  ldab  #$01    ; mask for mcr
  pshb
  ldab  #5+lv_ios ; mcr is bit 40
  ldy PLC   ; point y to byte
  aby
```

```
    jmp le_enable
  le_cmr
    ldab  #5+lv_ios ; mcr is bit 40
    ldy PLC    ; point y to byte
    aby
    ldab  #$01     ; mask to set it
    jmp le_sbit
  le_btd
  le_dtb
  le_quad
  le_unimp
    ldaa  #$32
    jmp flasher    ; code .. unimplemented feature

  ; two byte ops:
  ;  stack is mask, nextOp.w, y^ is addr
  j_2b  equ *-$0008    ; op/2
    db  le_if-*
    db  le_ifnot-*
    db  le_and-*
    db  le_andnot-*
    db  le_or-*
    db  le_ornot-*
    db  le_enable-*
    db  le_latch-*
    db  le_unlatch-*
  le_if
    ldx PLC
    pula       ; mask
    anda  0,y    ; Z bit is not x
    tpa      ; put it in a2
    coma       ; set for straight if
    staa  lv_sign,x
    bra le_1x
  le_ifnot
    ldx PLC
    pula
    anda  0,y
    tpa
    staa  lv_sign,x
    bra le_2x
  le_and
    ldx PLC
    pula
    anda  0,y
    tpa
    coma
    anda  lv_sign,x
    staa  lv_sign,x
  le_2x bra le_1x
  le_andnot
    ldx PLC
    pula
    anda  0,y
    tpa
    anda  lv_sign,x
    staa  lv_sign,x
    bra le_2x
  le_or
    ldx PLC
```

```
  pula
  anda  0,y
  tpa
  coma
  oraa  lv_sign,x
  staa  lv_sign,x
  bra le_2x
le_ornot
  ldx PLC
  pula
  anda  0,y
  tpa
  oraa  lv_sign,x
  staa  lv_sign,x
  bra le_2x
le_enable
  pulb
  ldx PLC
  ldaa  lv_sign,x
  bita  #$04
  beq le_cbit
le_sbit orab  0,y   ; set it from mask
  bra le_tbit
le_cbit comb      ; clear it from mask
  andb  0,y
le_tbit stab  0,y
  bra le_2x
le_latch
  pulb
  ldx PLC
  ldaa  lv_sign,x
  bita  #$04
  bne le_sbit
  bra le_2x
le_unlatch
  pulb
  ldx PLC
  ldaa  lv_sign,x
  bita  #$04
  bne le_cbit
  bra le_2x

; three byte ops:
;  stack is value.w (or .b.b), nextOp.w
;  for put y^ is counter
j_3b4 equ *-$0040   ; math K.w
  db  le_get-*
  db  le_plus-*
  db  le_minus-*
  db  le_cmp-*
  db  le_times-*
  db  le_gozinta-*
  db  le_put-*
le_get
  ldx PLC
  pula      ; value
  pulb
  std lv_acc,x
le_3x bra le_2x
le_plus
```

```
  ldx PLC
  ldab  #$fd     ; clear less bit
  andb  5+lv_ios,x
  stab  5+lv_ios,x
  pula       ; value
  pulb
  addd  lv_acc,x
  std lv_acc,x
  bvc le_3x
le_less ldab  #$02     ; set less bit
le_sleg orab  5+lv_ios,x
  stab  5+lv_ios,x
  bra le_3x
le_minus
  ldx PLC
  ldab  #$f1     ; clear less,equal,greater
  andb  5+lv_ios,x
  stab  5+lv_ios,x
  ldd lv_acc,x
  puly
  sty lv_temp,x
  subd  lv_temp,x
  std lv_acc,x
le_leg  bcs le_less    ; if goes minus, r<op
  beq le_equ
  ldab  #$08     ; if r>op
  bra le_sleg
le_equ  ldab  #$04     ; if r=op
  bra le_sleg
le_cmp
  ldx PLC
  ldd lv_acc,x
  puly
  sty lv_temp,x
  cpd lv_temp,x
  bra le_leg
le_times
le_gozinta
  jmp le_unimp
le_put
  pulx       ; dump values
  ldx PLC
  ldd lv_acc,x
  std 0,y
  bra le_3x

j_3b5 equ *-$0050
  db  le_jmz-*  ; d.w
  db  le_jmp-*
  db  le_nop3-*
  db  le_nop3-*
  db  le_shf-*  ; r.b, r.b
  db  le_rsf-*
  db  le_pack-*
  db  le_unpack-*
  db  le_cntdn-*  ; t.b, r.b
  db  le_read-* ; i.b, i.b
le_jmz
  ldx PLC
  ldaa  lv_sign,x ; state of rung
```

```
  bita  #$04
  beq le_jmp     ; jump if not true
  pulx       ; else dump displacement
  pulx
  jmp plc_cycle
le_jmp
  tsx      ; point at disp, next
  ldd 0,x    ; to get address of next op
  addd  2,x
  puly       ; adjust stack
  puly
  xgdx       ; and go to wherever
  jmp plc_cycle
le_rsf
  ldx PLC
  ldab  lv_sign,x
  bitb  #$04     ; if it's true
  beq le_3xxx
  pulb       ; get the 1st to clear
ler_1 pshb       ; save it while clearing
  clra
  jsr lo_bit     ; get mask, address
  comb       ; to clear it
  andb  0,y
  stab  0,y
  pulb       ; look see
  pula       ; if last one
  cba
  beq le_3xx     ; yes if b=a
  psha       ; else save last
  incb       ; and go do next
  bra ler_1
le_shf
  ldx PLC
  ldab  lv_sign,x
  bitb  #$04     ; if it's true
  beq le_3xxx
  clr lv_temp,x ; assume first is off
  pulb
les_1 incb       ; go to next
  pshb       ; save while busy
  clra
  jsr lo_bit     ; get mask, address
  ldx PLC
  pshb       ; save mask for a sec
  andb  0,y    ; to get old value
  tst lv_temp,x ; then look at last relay
  pula       ; to use mask
  bne :+1    ; to set it
  coma       ; or clear it
  anda  0,y
  staa  0,y
  bra :+2
: oraa  0,y
  staa  0,y
: stab  lv_temp,x ; and save old for next
  pulb       ; see if done
  pula
  cba
  beq le_3xx     ; if are
```

```
  psha        ; else   ve
  bra les_1
le_pack
  ldx PLC
  ldab  lv_sign,x
  bitb  #$04     ; if it's true
  beq le_3xxx
  clra
  clrb
  std lv_acc,x  ; start with all off
  pula        ; the last one (lsb)
  pulb        ; the first one
  psha
lep_1 pshb        ; save while packing
  clra
  jsr lo_bit     ; get mask, address
  andb  0,y    ; check bit
  addb  #$ff     ; sets carry if on
  ldx PLC
  rol lv_acc+1,x  ; to roll into accumulator
  rol lv_acc,x
  pulb        ; see if done
  pula
  cba
  beq le_3xx     ; if are
  psha        ; else save
  decb        ; to do next
  bra lep_1
le_3xxx pulx        ; dump params
le_3xx  pulx
  jmp plc_cycle
le_unpack
  ldx PLC
  ldab  lv_sign,x
  bitb  #$04     ; if it's true
  beq le_3xxx
  ldd lv_acc,x  ; use temp to roll out
  std lv_temp,x
  pulb        ; first to set (lsb)
leu_1 pshb        ; save while packing
  clra
  jsr lo_bit     ; get mask, address
  ldx PLC
  ror lv_temp,x ; roll from accumulator
  ror lv_temp+1,x ; into carry
  bcs :+1    ; to set it
  comb        ; to clear it
  andb  0,y
  stab  0,y
  bra :+2
: orab  0,y
  stab  0,y
: pulb        ; see if done
  pula
  cba
  beq le_3xx     ; if are
  psha        ; else save
  incb        ; to do next
  bra leu_1
le_nop3
```

```
le_cntdn
le_read
  jmp le_unimp

; four byte ops:
;  stack is tc.b, constant.w, nextOp.w
j_4b  equ *-$0070   ; base of 4 byte ops
  db  le_tap-*
  db  le_setc-*
  db  le_pset-*
  db  le_hsc-*
le_setc
  ldx PLC
  clra       ; d is tc number
  pulb
  puly       ; save constant in frame
  sty lv_temp+2,x
  pshb
  asld       ; times two
  addd  #lv_cnts  ; plus offset
  addd  PLC   ; plus frame start
  std lv_temp,x ; stash ^count in frame
  pulb       ; tc number again
  tba
  lsrb
  lsrb
  lsrb       ; byte number of done flag
  addb  #lv_tcds  ; with offset
  ldy PLC   ; points y to byte
  aby
  tab     ; get bit num back for mask
  andb  #$07
  ldx #lo_masks
  abx
  ldaa  0,x   ; mask in a, ^done in y

  ldx PLC   ; first look at this rung
  ldab  lv_sign,x
  bitb  #$04    ; if it's true
  bne le_rset   ; then reset tc
  bita  0,y   ; now see if already done
  bne le_setr   ; just set run, flag if so

  ldab  lv_bump,x ; now see if bump is there
  beq le_setf   ; set rung false if no
  bpl le_seta   ; do bump if from time
  pshy       ; save address of done flag for a sec
  ldab  #lv_tcrs-lv_tcds ; so we can check count rung flag
  aby     ; which is at done+#tcs/2
  bita  0,y   ; this is what it was
  puly       ; restore address of done flag
  bne le_sett   ; if still true and waiting
  ldab  #$01    ; if an edge bump count
le_seta psha      ; save mask for a sec
  pshy       ; as well as ^done
  clra       ; d is bump
  ldy lv_temp,x ; y is ^count
  addd  0,y
  bcc :+1
  ldd #$ffff    ; stop at max
```

```
: std 0,y
  cpd lv_temp+2,x ; compare to constant
  puly
  pula
  bcs le_setr
  tab     ; if there, use mask
  orab  0,y   ; to set done flag
  stab  0,y
le_setr ldab  #lv_tcrs-lv_tcds ; get to rung flag to set it
  aby     ; which is at done+#tcs/2
  tst lv_bump,x ; bump <0 is counting and true
  bmi le_sett   ; so do it
le_setf coma      ; else show it false
  anda  0,y
  staa  0,y
  bra le_setx
le_sett oraa  0,y
  staa  0,y
  bra le_setx
le_rset tab     ; reset, use mask
  comb
  andb  0,y   ; to clear done flag
  stab  0,y
  pshy
  ldy lv_temp,x
  clr 0,y   ; and clear counter
  clr 1,y
  puly
  bra le_setr   ; then go save state of rung

le_pset
  pulb
  pulx      ; get value
  ldy PLC
  ldaa  lv_sign,y
  bita  #$04    ; if it's true
  beq le_setx
  clra      ; then d is tc number
  asld      ; times two
  addd  #lv_cnts  ; plus offset
  addd  PLC   ; plus frame start
  xgdx
  std 0,x   ; put it there
le_setx pulx      ; nextop back
  jmp plc_cycle
le_tap
  ldx PLC
  clr lv_sign,x ; assume no hit
  clra      ; d is tc number
  pulb
  asld      ; times two
  addd  #lv_cnts  ; plus offset
  addd  PLC   ; plus frame start
  xgdx      ; ^count in x
  pula      ; constant in d
  pulb
  cpd 0,x
  bhi le_setx   ; if const>count
  ldx PLC
  ldaa  #$04    ; else hit it
```

```
  staa  lv_sign,x
  bra le_setx
le_hsc
  jmp le_unimp
```

The preferred embodiment of the present invention has now been described. This preferred embodiment constitutes the best mode contemplated by the inventor for carrying out his invention. Because the invention may be copied without copying the precise details of the preferred embodiment, the following claims particularly point out and distinctly claim the subject matter which the inventor regards as his invention and wishes to protect:

I claim:

1. An improved flying paster for splicing the leading edge of the leading end of a new web of material, which is wound, as a first roll, on and about a first central core, to the trailing end of a running web of material which is wound, as a second roll, on and about a second central core, which is running through and out of the flying paster as it is unwound from the second, running roll, the improved flying paster comprising:

first and second side walls that are spaced apart a distance greater than the widths of the first and second rolls and that have a bottom surface and an upper surface;

means for mounting the ends of the first central core for rotation with respect to the first and second side walls so that the new roll is disposed in a splicing position between the first and second side walls;

means for mounting the ends of the second central core for rotation with respect to the first and second side walls so that the second, running roll is disposed in an operating, unwinding position between the first and second side walls and so that the running web may be unwound from the second roll and may be thereafter run through and out of the flying paster;

a movable brake and roll accelerator assembly mounted in the flying paster adjacent and movable with respect to a side wall, with the movable brake and roll accelerator assembly being movable between a first position adjacent to the splicing position and a second position adjacent to the operating position;

a fixed brake and brake accelerator assembly mounted in the flying paster adjacent to a side wall and to the operating position;

means for selectively connecting an end of the first central core with the movable brake and roll accelerator assembly so as to enable the movable brake and roll assembly to cause and control rotation of the new roll;

means for selectively connecting an end of the second central core with the fixed brake and brake accelerator assembly so as to enable the fixed brake and roll assembly to cause and control the rotation of the second, running roll;

means for controlling the operation of selectively one of the fixed brake and brake accelerator assembly and the movable brake and roll accelerator assembly so that the running web is maintained under positive controlled tension, at all times, as it unwinds;

a tension control dancer mounted with the flying paster and so as to receive the running web as it exits from the flying paster, with the dancer including means for providing an input control signal to the controlling means concerning the web tension condition of the running web as it passes through the dancer, which signal functions to control the operation of the selected assembly so as to maintain the running web under positive tension control at all times;

means for causing a portion of the running web, which is downstream from the second, running roll, to run adjacent to the leading end of the web on the new roll;

means for causing the movable brake and roll accelerator assembly to rotate the new roll so that the speed of the new roll matches the speed of the running web;

means for cutting the running web when the running web is adjacent to the web on the new roll;

means for splicing the leading end of the new roll with the trailing end of the web then running from the second roll when the speed of the new roll matches the speed of the running web;

means for transferring the operational control of the selected brake and accelerator assembly from the fixed brake and brake accelerator assembly to the movable brake and roll accelerator assembly upon the splicing of the leading end of the new roll with the trailing end of the running web from the second roll;

means for disconnecting the second central core from the fixed brake and brake accelerator assembly after transfer of the operational control to the movable brake and roll accelerator assembly;

mean for moving the new, now-running roll from the splicing position to the operating position;

means for connecting an end of the first central core with the fixed brake and brake accelerator assembly so as to enable the fixed brake and brake accelerator assembly to cause and control rotation of the new, now-running roll;

means for disconnecting the end of the first central core from the movable brake and roll accelerator assembly after connection has been made between the first central core and the fixed brake and brake accelerator assembly; and means for transferring the operational control of the new now running roll from the movable brake and roll accelerator assembly to the fixed brake and brake accelerator assembly upon disconnection of the first central core and the movable brake and roll accelerator assembly.

2. The improved flying paster of claim 1 which includes means for permitting the second central core, and any remaining web wound thereon, to be moved from the operating position, from the flying paster after disconnection of the second central core and the fixed brake and brake accelerator assembly.

3. The improved flying paster of claim 1, which includes means for moving the movable brake and roll accelerator assembly with the new, now-running roll, as the new roll moves from the splicing position to the operating position, between its first position and its second position.

4. The improved flying paster of claim 3 which includes means for moving the movable brake and roll accelerator assembly from its second position to its first position after disconnection of the end of the first central core from the movable assembly.

5. The improved flying paster of claim 1 which includes means for causing the movable brake and roll accelerator assembly to accelerate the new roll, prior to splicing, such that the diameter of the new roll, the weight of the new roll, the angle between a brake pulse and a predetermined colored mark on the new roll, the frictional forces involved, and the efficiency of the movable assembly can be calculated.

6. The improved flying paster of claim 2 which includes means for moving the movable brake and roll accelerator assembly with the new, now-running roll, as the new roll moves from the splicing position to the operating position, between its first position and its second position.

7. The improved flying paster of claim 6 which includes means for moving the movable brake and roll accelerator assembly from its second position to its first position after disconnection of the end of the first central core shaft from the movable assembly.

8. The improved flying paster of claim 7 which includes means for causing the movable brake and roll accelerator assembly to accelerate the new roll, prior to splicing, such that the diameter of the new roll, the weight of the new roll, the angle between a brake pulse and a predetermined colored mark on the new roll, the frictional forces involved, and the efficiency of the movable assembly can be calculated.

* * * * *